US008402726B2

(12) United States Patent
Iwasaki et al.

(10) Patent No.: US 8,402,726 B2
(45) Date of Patent: Mar. 26, 2013

(54) PACKAGING MACHINE AND SUCTION CONTROL APPARATUS

(75) Inventors: Yoshio Iwasaki, Shiga (JP); Makoto Ichikawa, Shiga (JP); Yusuke Kiyota, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 352 days.

(21) Appl. No.: 12/844,108

(22) Filed: Jul. 27, 2010

(65) Prior Publication Data

US 2011/0023423 A1 Feb. 3, 2011

(30) Foreign Application Priority Data

Jul. 29, 2009 (JP) ..... 2009-176965

(51) Int. Cl.
*B65B 41/12* (2006.01)

(52) U.S. Cl. ..... 53/551; 53/389.5

(58) Field of Classification Search ..... 53/550, 53/551, 389.5, 451; 198/689.1; 700/301
See application file for complete search history.

(56) References Cited

U.S. PATENT DOCUMENTS 4,578,931 A * 4/1986 Roovers ..... 53/551
5,125,217 A * 6/1992 Fukuda ..... 53/551
6,314,706 B1 * 11/2001 Araki et al. ..... 53/451
7,775,520 B2 * 8/2010 Matsudaira et al. ..... 271/284
2007/0216087 A1 * 9/2007 Matsudaira et al. ..... 271/265.04

FOREIGN PATENT DOCUMENTS

| | | | |
|---|---|---|---|
| EP | 0758609 | A1 | 2/1997 |
| EP | 0832818 | A1 | 4/1998 |
| GB | 2096091 | A | 10/1982 |
| JP | 2002-166904 | A | 6/2002 |
| JP | 2004-155465 | A | 6/2004 |
| WO | WO-03/091110 | A1 | 11/2003 |

OTHER PUBLICATIONS

Extended European Search Report dated Jan. 21, 2011 for the counterpart European Patent Application No. 10171129.9.

* cited by examiner

*Primary Examiner* — M. Alexandra Elve
*Assistant Examiner* — Andrew M Tecco
(74) *Attorney, Agent, or Firm* — Global IP Counselors, LLP

(57) ABSTRACT

A suction control apparatus is adapted to be used in a packaging machine for conveying and packaging a belt-shaped film while the film is being suctioned by a suction-type film conveyor. The suction control apparatus includes a proper vacuum-degree determination section and a vacuum-degree control unit. The proper vacuum-degree determination section is configured and arranged to determine a proper degree of vacuum of the suction-type film conveyor, which is less than a reference value set in advance. The vacuum-degree control unit is configured to set the degree of vacuum to a first value corresponding to the proper degree of vacuum determined by the proper vacuum-degree determination section.

8 Claims, 17 Drawing Sheets

PACKAGING MACHINE AND SUCTION CONTROL APPARATUS

CROSS-REFERENCE TO RELATED APPLICATIONS

This application claims priority to Japanese Patent Application No. 2009-176965 filed on Jul. 29, 2009. The entire disclosure of Japanese Patent Application No. 2009-176965 is hereby incorporated herein by reference.

BACKGROUND

1. Technical Field

The present invention relates to a packaging machine for forming a bag and using the bag to package an article, as well as a suction control apparatus included in a packaging machine.

2. Related Art

Packaging machines have been known in the art (see Japanese Laid-Open Patent Application No. 2002-166904 and Japanese Laid-Open Patent Application No. 2004-155465, for example).

Japanese Laid-Open Patent Application No. 2002-166904 discloses a filling and packaging machine. The filling and packaging machine forms a continuous packaging bag by longitudinally and laterally sealing a film using longitudinal and lateral sealing mechanisms, the film being fed out from a film roller; and the filling and packaging machine fills the interior of the continuous packaging bag P with a filler substance. The filling and packaging machine comprises a sealing plate, temperature detection means, temperature adjustment means, and control means. The sealing plate is set up on a pair of heat seal rolls to which the longitudinal and lateral sealing mechanisms are provided. The sealing plate is heated by an electric heater. The temperature detection means detects the temperature of the sealing plate. Temperature adjustment means adjusts the temperature of the sealing plate on the basis of temperature information detected by the temperature detection means. The control means has a power-saving mode. The power-saving mode makes it possible to set a proper temperature in the temperature adjustment means K4, and controls the temperature adjustment means so as to cease heating of the sealing plate or set temperature lower than the proper temperature.

The packaging machine of Japanese Laid-Open Patent Application No. 2004-155465 comprises a pair of front and rear sealing jaws and a pair of rotation shafts. The packaging machine also comprises a first servo motor for driving the sealing jaws around the rotation shafts and a second servo motor for driving the rotation shafts so as to bring them closer together or move them apart from each other in a horizontal direction. The packaging machine causes the first servo motor and the second servo motor to function in tandem, and moves the sealing jaws so as to describe a D-shaped trajectory. The packaging machine ceases the supply of power to respective heaters of the longitudinal sealing mechanism and the lateral sealing mechanism while the power supply to the servo motors is on. On the other hand, while the power supply to the servo motors is off, the power supply to the heaters is permitted and the power supply periods of the heaters are controlled so as not to overlap each other.

SUMMARY

With the packaging machines disclosed in Japanese Laid-Open Patent Application No. 2002-166904 and Japanese Laid-Open Patent Application No. 2004-155465, it is possible to minimize power consumption in the sealing devices included in the packaging machine, but it has been difficult to minimize power consumption in the other devices included in the packaging machines.

In view whereof, it is an object of the present invention to provide a packaging machine or a suction control apparatus included in the packaging machine in which the power consumption of the entire packaging machine is reduced.

A suction control apparatus according to a first aspect is adapted to be used in a packaging machine for conveying and packaging a belt-shaped film while the film is being suctioned by a suction-type film conveyor. The suction control apparatus includes a proper vacuum-degree determination and a vacuum-degree control unit. The proper vacuum-degree determination section is configured and arranged to determine a proper degree of vacuum of the suction-type film conveyor, which is less than a reference value set in advance. The vacuum-degree control unit is configured to set the degree of vacuum to a first value corresponding to the proper degree of vacuum determined by the proper vacuum-degree determination section.

The term "reference value" used herein refers to a prescribed value corresponding to a degree of vacuum whereby the film can is surely conveyed, irrespective of the surface state, material, or thickness of the film, the shape of the bag when the bag is produced, or other characteristics; as well as the environment (air temperature, humidity, etc.).

Since control is performed for setting the degree of vacuum to a first value corresponding the proper degree of vacuum, which is lower than the reference value, the energy used for suctioning can be reduced to less than conventional practice.

Furthermore, the suction control apparatus preferably further includes a conveying state detection unit and a storage unit. The conveying state detection unit is configured and arranged to detect a speed at which the film is conveyed or a conveying time required for a predetermined length of the film to be conveyed. The storage unit is configured and arranged to store a set speed value for the conveying speed or a set time value for the conveying time. The vacuum-degree control unit is preferably further configured to adjust the degree of vacuum so that the conveying speed falls within a predetermined range with respect to the set speed value, or so that the conveying time falls within a predetermined range with respect to the set conveying time value.

The term "predetermined range with respect to the set speed value" used herein refers to values (conveying speed values) included in a range established using the set speed value as a reference, and the term "predetermined range with respect to the set conveying time value" used herein refers to values (conveying time values) included in a range established using the set time value as a reference.

Degree of vacuum control is performed based on the set speed value of the conveying speed or the set time value of the conveying time stored in the storage unit, so that the conveying speed value comes within the predetermined range with respect to the set speed value or the conveying time comes within the predetermined range with respect to the set conveying time value. This makes it possible, e.g., for the suction-type film conveyor to be operated with minimal energy, and the film to be conveyed efficiently. As a result, it is possible to reduce the energy consumed by the entire packaging machine.

It is also preferred that the conveying state detection unit be a register mark sensor configured and arranged to detect a register mark printed on the film. By detecting a register mark, it is possible to reliably detect not only the positional alignment of the film, but also the conveying speed of the film or the conveying time of the film. Particularly, it is possible to reliably detect the conveying speed or the conveying time when the film is sliding against the suction-type film conveyor.

Furthermore, the vacuum-degree control unit is preferably configured to lower the degree of vacuum from the reference value to the first value on the basis of condition information pertaining to at least one condition among a plurality of conditions including a surface state of the film, material of the film, a thickness of the film, and a shape of the bag to be produced, and also on the basis of information of the proper degree of vacuum determined in advance by the proper vacuum-degree determination section under the condition corresponding to the condition information. By setting beforehand the condition information and the information of the proper degree of vacuum that is determined in advance under conditions corresponding to the condition information, the suction-type film conveyor can be used with the proper degree of vacuum suited to various types of films or various types of bags in operations that follow the establishment of settings. As a result, energy usage can be reduced more so than in conventional practice regardless of the type of film or bag.

Furthermore, the storage unit is preferably configured and arranged to store temporary information, which is information on the proper degree of vacuum determined by the proper vacuum-degree determination section during a temporary operation prior to a main operation, and the vacuum-degree control unit is preferably configured to control a vacuum-degree adjustment unit included in the suction-type film conveyor at the proper degree of vacuum on the basis of the temporary information. The term "main operation" herein refers to an operation for actually manufacturing products. The term "temporary operation" herein refers to an operation other than the main operation, for example, an operation for producing any number of bags not yet having contents prior to the main operation, or for producing any number of bags with a sample film. For example, information on the proper degree of vacuum is obtained in advance during the temporary operation. Using information on the proper degree of vacuum obtained during the temporary operation in the main operation makes it possible to operate with the proper degree of vacuum from the start of the main operation. From the very beginning of operation, the energy usage can thereby be reduced more so than in conventional practice.

Furthermore, the storage unit is preferably configured and arranged to store main information, which is information on the proper degree of vacuum determined by the proper vacuum-degree determination section during a main operation, and the vacuum-degree control unit is preferably configured to control a vacuum-degree adjustment unit included in the suction-type film conveyor at the proper degree of vacuum on the basis of the main information. Information on the proper degree of vacuum can thereby be obtained and the machine can be operated using this information at the proper degree of vacuum when products are being manufactured (during the main operation). As a result, energy usage can be reduced more so than in conventional practice, even during operation.

The packaging machine also includes the suction control apparatus as described above and a suction-type film conveyor. The suction-type film conveyor is controlled by the suction control apparatus, and the suction-type film conveyor conveys a belt-shaped film while suctioning the film. Since the suction control apparatus reduces the energy used by the suction-type film conveyor, the energy used by the entire packaging machine can be reduced.

BRIEF DESCRIPTION OF THE DRAWINGS

Referring now to the attached drawings which form a part of this original disclosure.

DETAILED DESCRIPTION OF EXEMPLARY EMBODIMENTS

The following is a description, made with reference to FIGS. 1 through 10, of a combination weighing system 1 equipped with a packaging machine 3 according to an embodiment of the present invention. Also described are mechanisms 73, 10*b*, which function as suction control apparatuses included in the packaging machine 3.

Figure 1:
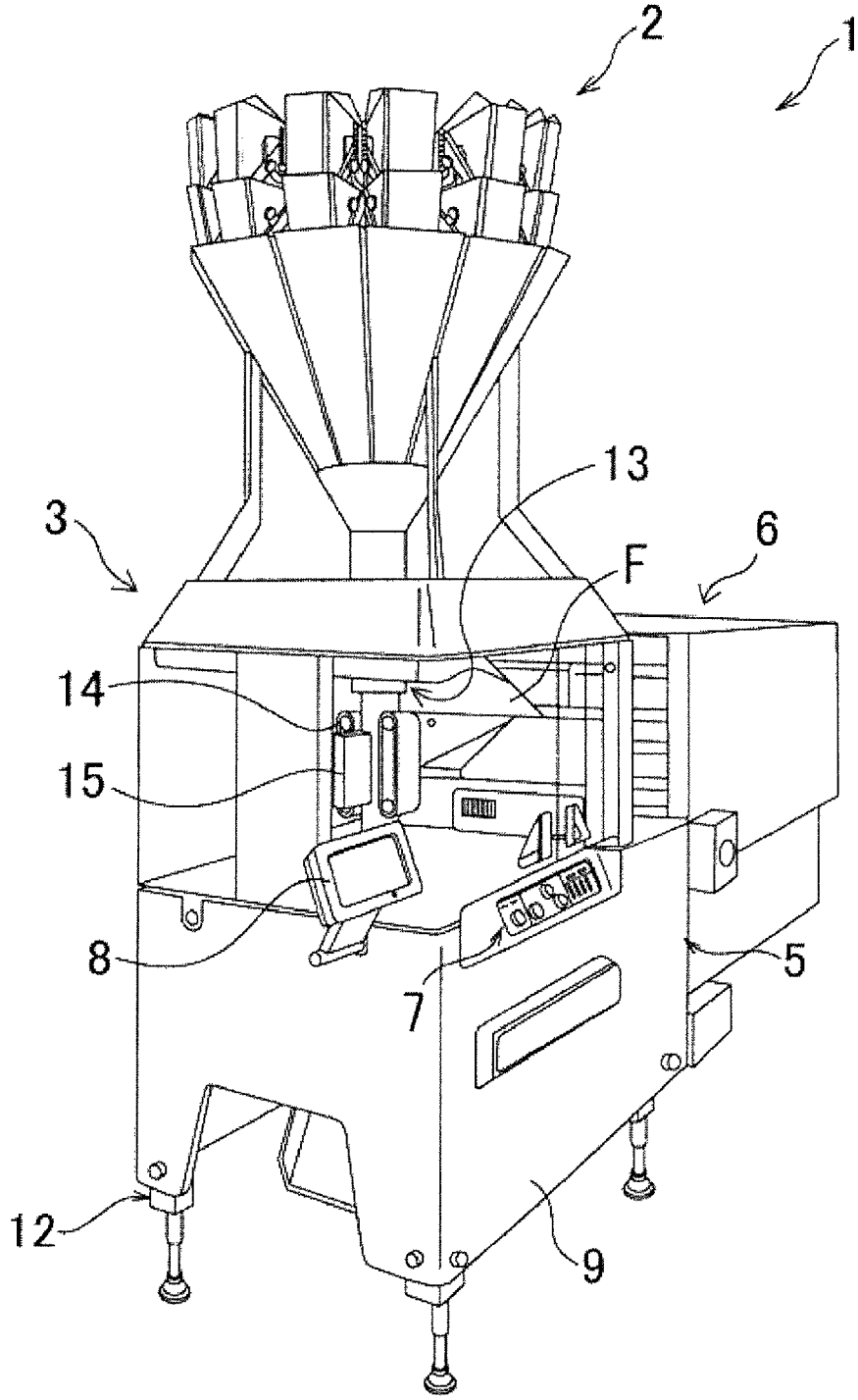
FIG. 1 is an external view of a combination weighing system including a film supply apparatus (film supply unit) according to an embodiment of the present invention.

FIG. 1 shows an external view of a combination weighing system 1. The combination weighing system 1 is a machine for weighing potato chips or other products C (see FIG. 2) as packaged materials, shaping a film into a cylindrical film and covering the weighed products C with the cylindrical film, and longitudinally and laterally sealing the cylindrical film, thus manufacturing bagged products B.

The combination weighing system 1 comprises mainly a combination weighing machine 2 and a packaging machine 3.

As shown in FIG. 1, the combination weighing machine 2 is disposed at the top of the packaging machine 3, which is described hereinafter. After the combination weighing machine 2 has weighed the products C in predetermined weight increments with weighing hoppers, the products C are retained in the weighing hoppers. Furthermore, the combination weighing machine 2 combines the weight values of the products C so that the values constitute a predetermined total weight. Furthermore, the combination weighing machine 2 sequentially discharges the products C that have been combined for a predetermined total weight from the weighing hoppers.

The packaging machine 3 uses a film F to bag the products C that have been discharged at predetermined total weight increments as a result of the weighing in the combination weighing machine 2. The packaging machine 3 will be described in detail hereinafter.

The packaging machine 3 is configured mainly from a bag-making and packaging unit 5 and a film supply unit 6, as shown in FIG. 1. The bag-making and packaging unit 5 is a main component for bagging the products C. The film supply unit 6 supplies the film F that will form the bag to the bag-making and packaging unit 5. Operating switches 7 are disposed on the front face of the bag-making and packaging unit 5. A liquid crystal display 8 is disposed in a position visible to an operator who operates the operating switches 7. The liquid crystal display 8 shows the operating state.

The film supply unit 6 is a unit for supplying the sheet-shaped film F to a molding mechanism 13 of the bag-making and packaging unit 5 described hereinafter. The film supply unit 6 is herein provided adjacent to the bag-making and packaging unit 5. Film rolls FR1, FR2 (see FIG. 4) around which the film F is wound are set into the film supply unit 6, and the film F is fed out from the film rolls FR1, FR2. The film supply unit 6 will be described in detail hereinafter.

Figure 2:
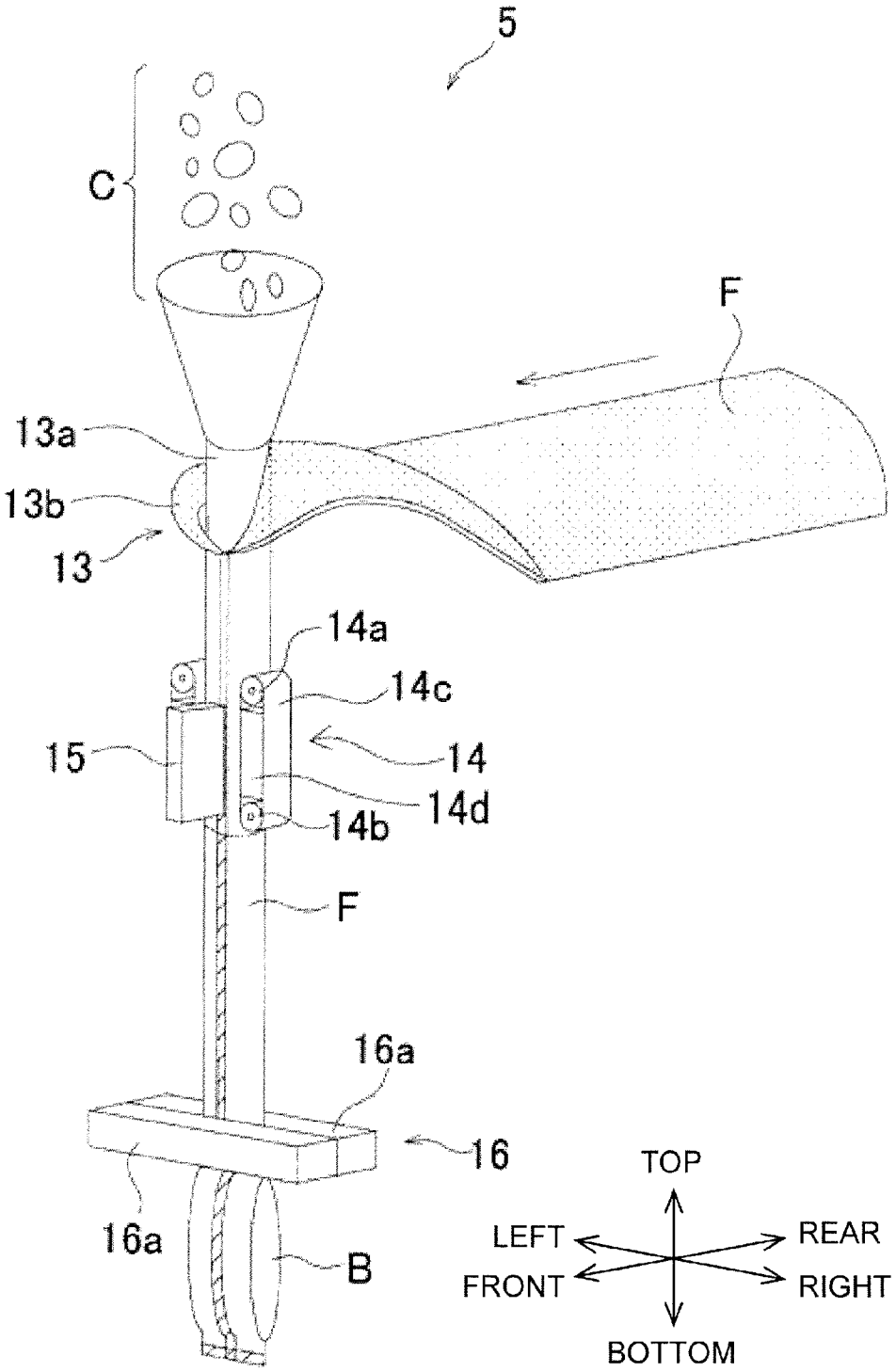
FIG. 2 is a perspective view showing the configuration of a bag-making and packaging unit included in the combination weighing system 1 of FIG. 1.

The bag-making and packaging unit 5 is configured from the molding mechanism 13, a pull-down belt mechanism 14, a longitudinal sealing mechanism 15, a lateral sealing mechanism 16, and a support frame 12 for supporting these mechanisms, as shown in FIGS. 1 and 2. The molding mechanism 13 molds the sheet-shaped film F into a cylindrical-shaped film. The pull-down belt mechanism (suction-type film conveyor) 14 conveys downward the film F that has been formed into a cylindrical-shaped film (hereinbelow referred to as the cylindrical film F). The longitudinal sealing mechanism 15 longitudinally seals (heat seals) the overlapping portion of the cylindrical film F. The lateral sealing mechanism 16 closes up the top and bottom ends of the bag by laterally sealing the cylindrical film F. A casing 9 is attached around the periphery of the support frame 12.

Detailed Configuration of Bag-Making and Packaging Unit 5

The molding mechanism 13 has a tube 13*a* and a former 13*b* as shown in FIG. 2. The tube 13*a* is a cylindrical-shaped member and is open at the top and bottom ends. Weighed products C are dropped from the combination weighing machine 2 into the opening at the top end of the tube 13*a*. The former 13*b* is disposed so as to enclose the tube 13*a*. The former 13*b* is shaped so that the sheet-shaped film F fed from the film supply unit 6 is molded into a cylindrical shape when passing between the former 13*b* and the tube 13*a*.

Figure 3:
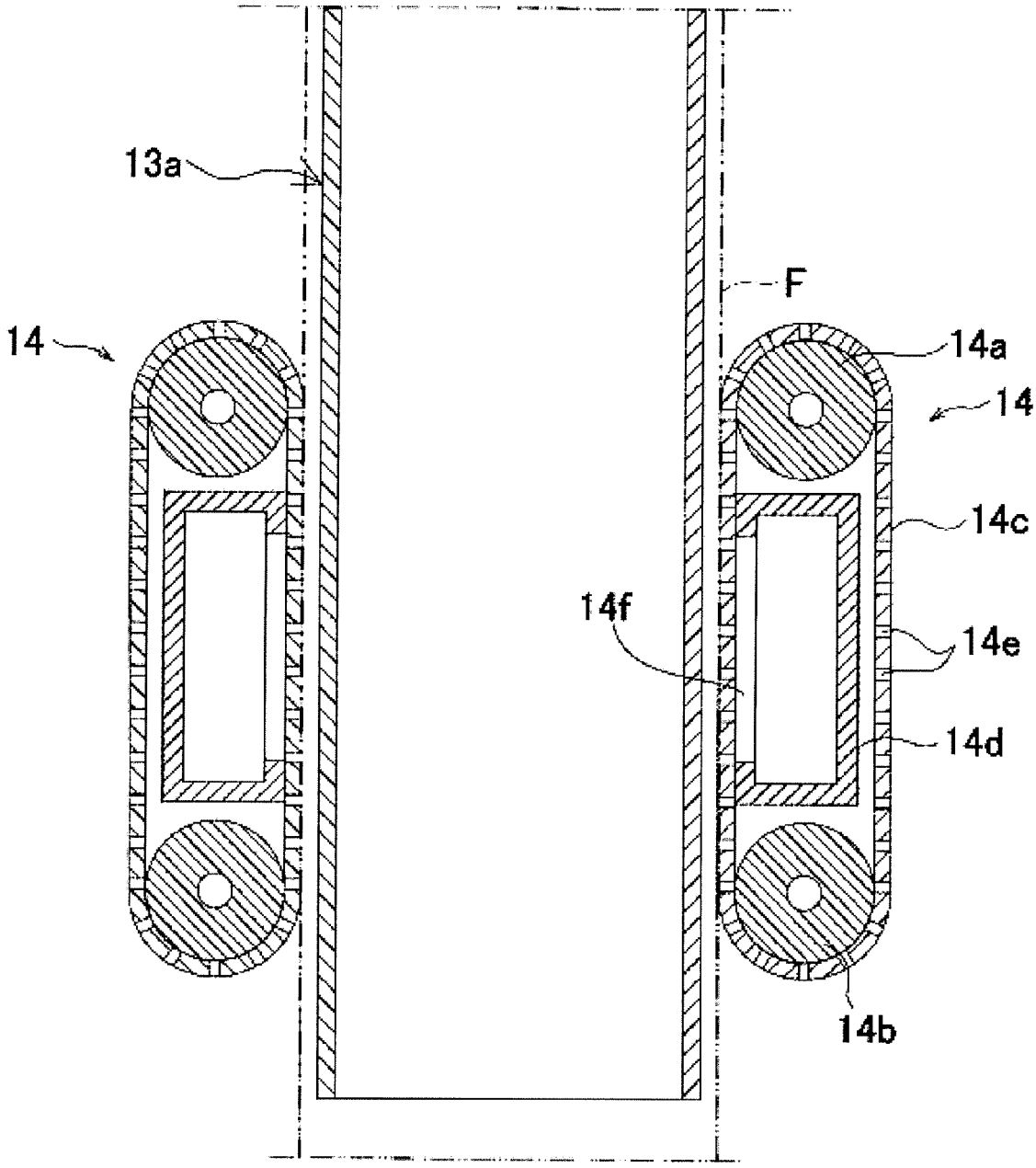
FIG. 3 is a cross-sectional view of a pull-down belt mechanism (suction-type film conveyor) in the bag-making and packaging unit of FIG. 2.

As shown in FIGS. 2 and 3, the pull-down belt mechanism 14 is a mechanism whereby the cylindrical film F wrapped around the tube 13*a* is conveyed downward with suctioning. The pull-down belt mechanism 14 is configured mainly from a drive roller 14*a*, a driven roller 14*b*, a belt 14*c*, an air intake box 14*d*, and a vacuum pump 72. The belt 14*c* is fitted around the drive roller 14*a* and the driven roller 14*b*. The belt 14*c* also has numerous air intake holes 14*e*. The air intake box 14*d* has a first surface on the side facing the tube 13*a*. The first surface is adjacent to the sliding belt 14*c*. A plurality of air intake slits 14*f* are provided together in the first surface of the air intake box 14*d*. The vacuum pump 72 suctions air in the air intake box 14*d*. In FIGS. 2 and 3, the drive motor for rotating the drive roller 14*a* and other components is not shown, nor is the vacuum pump 72. The vacuum pump 72 will be described hereinafter.

The longitudinal sealing mechanism 15 is a mechanism for heating and longitudinally sealing the overlapping portions of the cylindrical film F wound around the tube 13*a* while pressing the overlapping portions against the tube 13*a* with a specified amount of pressure, as shown in FIG. 2. The longitudinal sealing mechanism 15 has a heater, a heater belt, and/or the like. The heater belt is heated by the heater and is in contact with the overlapping portions of the cylindrical film F. Though not shown in the drawings, the longitudinal sealing mechanism 15 also comprises a drive apparatus for moving the heater belt toward and away from the tube 13*a*.

The lateral sealing mechanism 16 includes a pair of sealing jaws 16*a*, 16*a* which internally house the heater belt or the like as shown in FIG. 2, as well as a drive apparatus (not shown) for moving the sealing jaws 16*a*, 16*a* toward and away from the cylindrical film F.

The sealing jaws 16*a*, 16*a* are members formed extending in a left-to-right direction. The sealing surfaces of the sealing jaws 16*a*, 16*a* are heated by the heater belt or the like housed therein. The cylindrical film F is heat-sealed by being pressed in between the left and right sealing jaws 16*a*, 16*a*.

The film supply unit 6 is an apparatus for supplying the film F to the bag-making and packaging unit 5 disposed downstream. The film supply unit 6 has a roll attachment part 17, a cutter 11, an automatic splicer (a splicer) 20, a conveying mechanism 30, a pinch roller (a pair of rollers) 35, and a tension roller 40.

Detailed Configuration of Film Supply Unit 6

Figure 4:
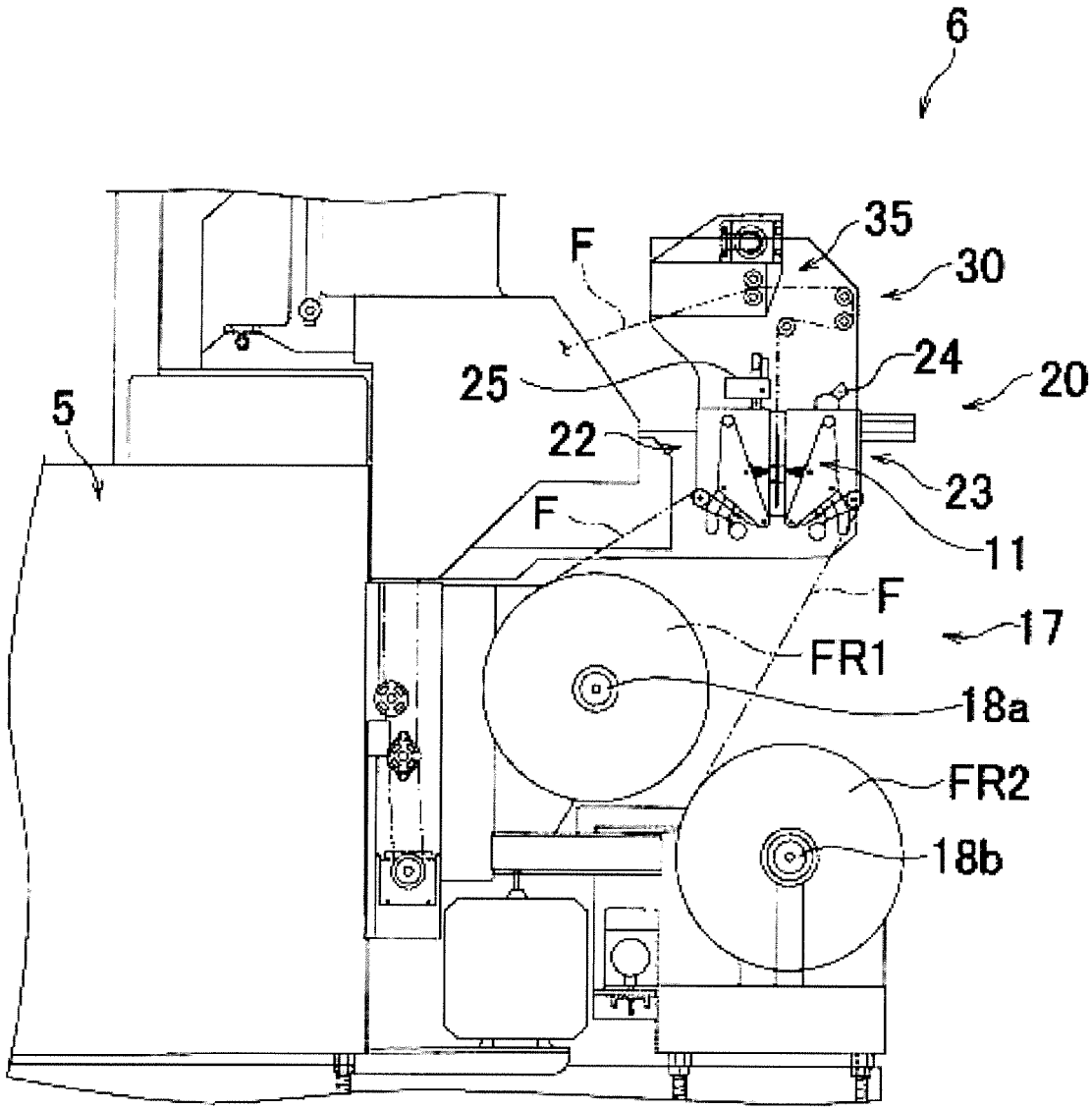
FIG. 4 is a front view showing the configuration of a film supply unit included in the packaging machine of the combination weighing system of FIG. 1.

The roll attachment part 17 is disposed at the bottom of the film supply unit 6, as shown in FIG. 4. The roll attachment part 17 includes two shafts (roll support parts) 18*a*, 18*b* and shaft drive parts (drive parts) 19*a*, 19*b* (see FIG. 7). The two shafts 18*a*, 18*b* rotatably support the film rolls around which the rectangular film F is wound.

In the following description, the supplying film roll (a film roll for supplying) FR1 is supported on the shaft 18*a*, and the backup film roll (a film roll for replacement) FR2 is supported on the shaft 18*b*.

The shaft 18*a* supports the supplying film roll FR1 in a rotatable manner as shown in FIG. 4. The film F of the supplying film roll FR1 is supplied to the bag-making and packaging unit 5 ahead of the film F of the backup film roll FR2.

The shaft 18*b* supports the backup film roll FR2 in a rotatable manner as shown in FIG. 4. The backup film roll FR2 is used after the film F of the supplying film roll FR1 supported on the shaft 18*a* has been used up.

Figure 7:
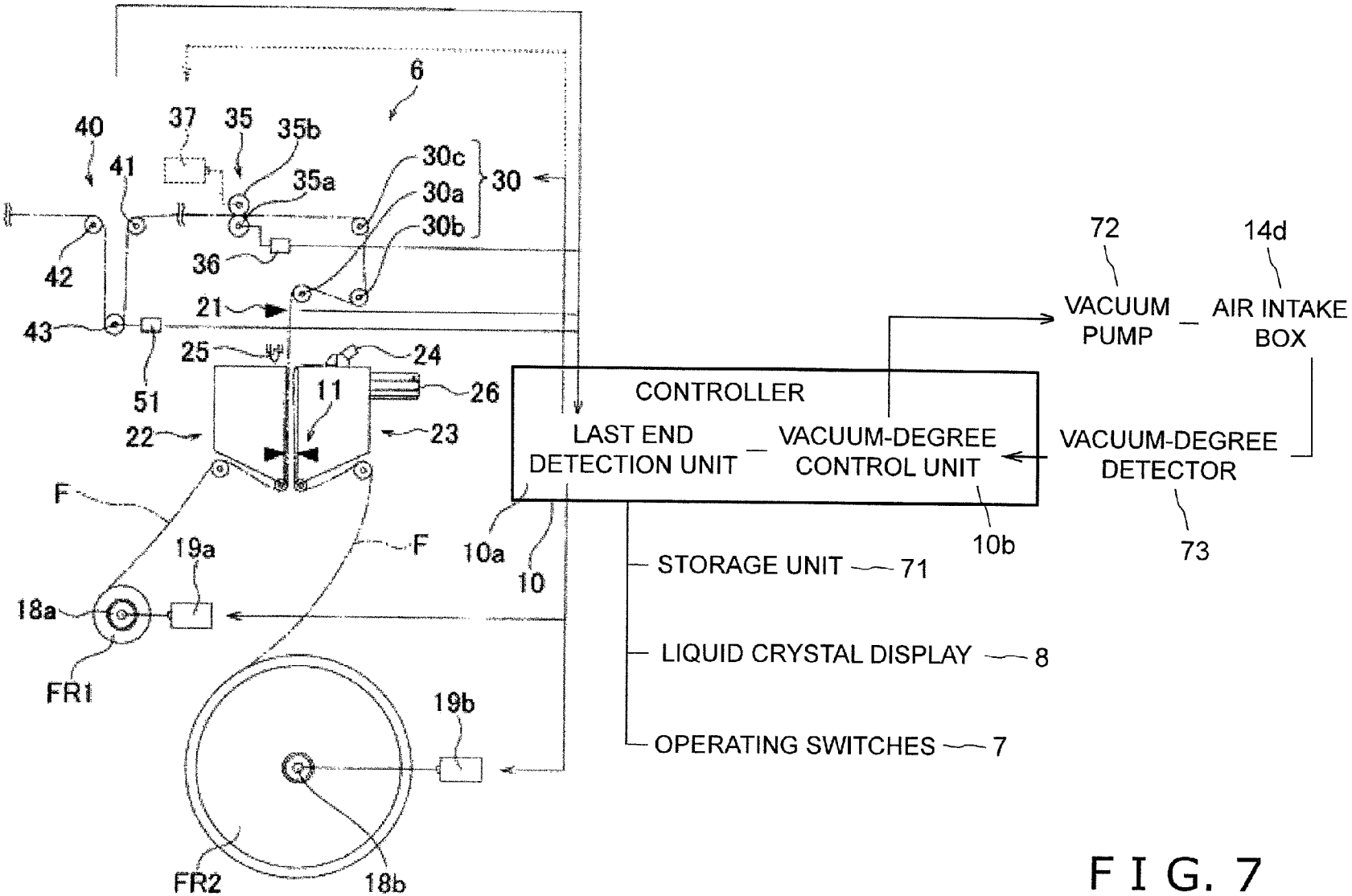
FIG. 7 is a control block diagram constituting the film supply unit of FIG. 4.

The shaft drive parts 19*a*, 19*b* are drive parts for rotating the shafts 18*a*, 18*b*, respectively (see FIG. 7).

Figure 6:
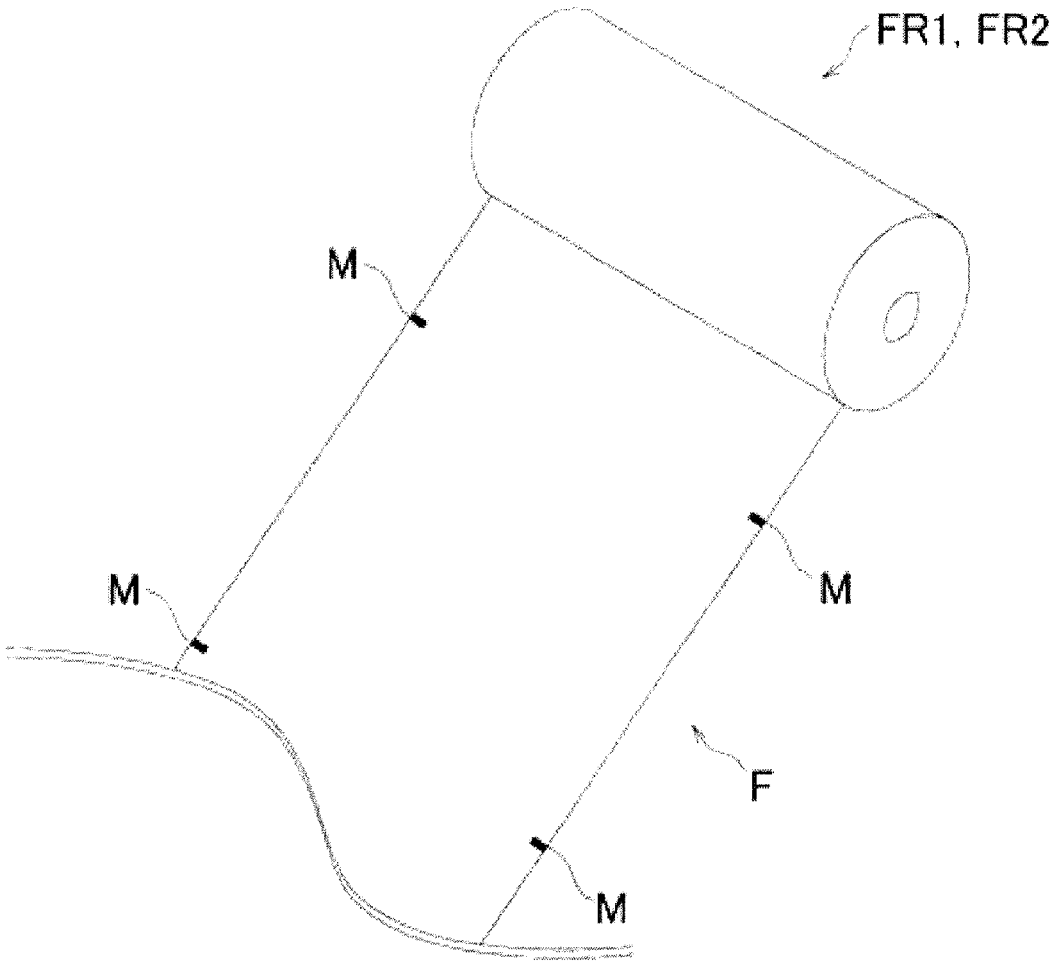
FIG. 6 is an explanatory drawing showing a register mark of a film roll.

Marks M are printed on the film F as shown in FIG. 6. The marks M are known as register marks (or registration marks). The register marks are printed in the same positions on the bags being formed, at equal intervals along the longitudinal direction in order to create a pattern printed on the film F. Therefore, the gaps between the register marks M correspond to the lengths of the bags. In the bag-making and packaging unit 5, the lateral seals, the timing of the cuts, and other factors are regulated by detecting the register marks M. Using the register marks M as markers, the film supply unit 6 also performs a joining process for joining together the last end of the supplying film F and the starting end of the backup film.

The cutter 11 is disposed between the roll attachment part 17 and a heat-sealing part 25 as shown in FIG. 4. The heat-sealing part 25 is included in the automatic splicer 20. In cases in which the film roll FR1 set on the shaft 18*a* is a fixed type of film roll, the cutter 11 cuts the last end portion of the film F on the film roll FR1 and separates the film F from the paper tube around which it is securely wound.

When the supplying film roll FR1 for supplying the film F to the bag-making and packaging unit 5 is used up, the automatic splicer 20 temporarily halts the conveying of the film F and heat-seals the last end portion area of the film F with the starting end portion area of the film F of the hereinafter-described replacement film roll FR2, automatically joining them together. Thereby, even in cases in which the first used film F of the supplying film roll FR1 has been used up, the conveying of the film F can be continued by joining the film F of the backup film roll FR2. The automatic splicer 20 is configured so as to include a register mark sensor (conveying state detection unit) 21, a front splicer 22, a back splicer 23, a temporary stopper 24, a heat-sealing part 25, a cylinder 26, and a support plate 28, as shown in FIGS. 4 and 5.

Figure 5:
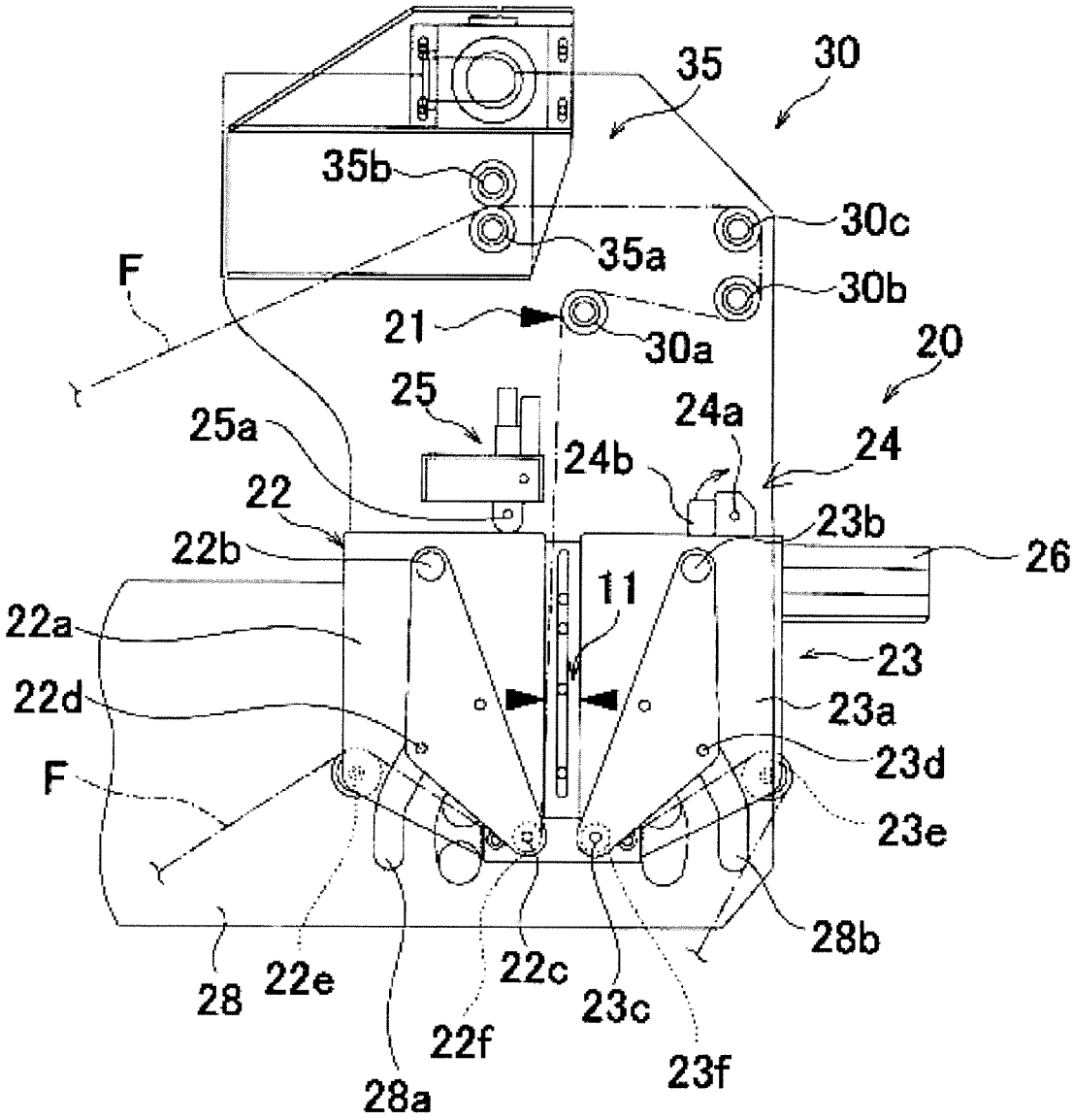
FIG. 5 is a front view showing the configuration of an auto-splicer included in the film supply unit of FIG. 4.

The register mark sensor 21 is disposed at the farthest downstream point of the automatic splicer 20 as shown in FIG. 5. The register mark sensor 21 detects the register marks M printed on the film F described above. The film F is positioned using the positions of the detected register marks M as a reference. Specifically, the film F being supplied is stopped at predetermined positions using the positions of the detected register marks M as a reference. After detecting one register mark M while the film F is being conveyed, the register mark sensor 21 detects the time duration until the next register mark M is detected, and detects the conveying time of the film F. In other words, the register mark sensor 21 detects the conveying time required in order to convey a predetermined length of the film F. A controller 10, described hereinafter, calculates the conveying speed of the film F on the basis of the conveying time of the film F detected by the register mark sensor 21 and the spaced intervals at which the register marks M are printed.

The front splicer 22 conveys the rectangular film F fed out from the supplying film roll FR1 downstream via rollers 22*e*, 22*f* as shown in FIG. 4. Specifically, the rectangular film F is conveyed above the front splicer 22 (see FIG. 5). With a handle 22*b* being pulled in a direction away from the back splicer 23, the front splicer 22 can rotate a main body 22*a* about a turning shaft 22*c*, as shown in FIG. 5. A space between the front splicer 22 and the back splicer 23 is thereby opened, and the ease of operation when replacing the supplying film roll FR1 and the backup film roll FR2 can be improved. When the main body 22*a* is rotated, a protrusion 22*d* fixed to the main body 22*a* moves along a guiding hole 28*a* formed in the support plate 28, and the protrusion 22*d* comes in contact with the bottom end of the guiding hole 28*a* at a predetermined angle. The turning of the main body 22*a* is thereby stopped at a predetermined turning angle. Furthermore, the heat-sealing part 25, described hereinafter, is disposed above the front splicer 22. The joined position of the last end area of the film F fed out from the supplying film roll FR1 and the joined position of the starting end area of the film F fed out from the backup film roll FR2 are heat-sealed and joined together by the heat-sealing part 25 in the top surface of the front splicer 22.

The back splicer 23 conveys the rectangular film F fed out from the backup film roll FR2 downstream via rollers 23*e*, 23*f* as shown in FIG. 4. Specifically, the rectangular film F is conveyed above the back splicer 23 (see FIG. 5). As with the front splicer 22, with a handle 23*b* being pulled in a direction away from the front splicer 22, the back splicer 23 can rotate a main body 23*a* about a turning shaft 23*c*, as shown in FIG. 5. A space between the front splicer 22 and the back splicer 23 is thereby opened, and the ease of operation when replacing the supplying film roll FR1 and the backup film roll FR2 can be improved. When the main body 23*a* is rotated, a protrusion 23*d* fixed to the main body 23*a* moves along a guiding hole 28*b* formed in the support plate 28, and the protrusion 23*d* comes in contact with the bottom end of the guiding hole 28*b* at a predetermined angle. The turning of the main body 22*a* is thereby stopped at a predetermined angle.

The temporary stopper 24 is disposed on the top surface of the back splicer 23 as shown in FIG. 5. The temporary stopper 24 is provided in order to temporarily stop the starting end of the film F on the top surface of the back splicer 23. After being fed out from the backup film roll FR2, the film F reaches the top surface of the back splicer 23 via the space between the front splicer 22 and the back splicer 23. The temporary stopper 24 has a turning shaft 24*a* and a clip 24*b*. The clip 24*b* turns about the turning shaft 24*a*. In the present embodiment, the register marks M printed on the film F are temporarily stopped so as to align with the clip 24*b*.

The heat-sealing part 25 is disposed on the top surface of the front splicer 22 as shown in FIG. 5. The heat-sealing part 25 brings a heating part 25*a* in contact with the heat-sealed portion of the film F while applying a predetermined amount of pressure. The heat-sealed portion is the portion where the last end area of the film F of the supplying film roll FR1 and the starting end area of the film F of the backup film roll FR2 will be joined together. Heat and pressure are thereby applied to the overlapping portion between the last end area of the film F fed out from the supplying film roll FR1 and the starting end area of the film F fed out from the backup film roll FR2, and the two films can easily be joined together.

The cylinder 26 is disposed on a side surface of the back splicer 23 as shown in FIG. 5. The cylinder 26 advances an insertion plate (not shown) up to the top surface of the front splicer 22. At this time, the starting end of the film F of the backup film roll FR2 and the last end of the film F of the supplying film roll FR1 are inserted together with the insertion plate (not shown) in between the top surface of the front splicer 22 and the heat-sealing part 25. The film F of the supplying film roll FR1 and the film F of the backup film roll FR2 are stopped in a state of having been positioned together. Specifically, the film F of the supplying film roll FR1 is positioned with a register mark M stopped at a predetermined position, and the film F of the backup film roll FR2 is positioned with a register mark M fixed in place at the temporary stopper. It is thereby possible, in the top surface of the front splicer 22, to form an overlapped state between the joining position of the starting end area of the film F of the backup film roll FR2 and the joining position of the last end area of the film F of the supplying film roll FR1.

The support plate 28 is a plate member for fixing the automatic splicer 20 in place on the support frame 12 on the side facing the bag-making and packaging unit 5. The guiding holes 28*a*, 28*b* are formed in the support plate 28 as shown in FIG. 5. The guiding holes 28*a*, 28*b* guide the protrusion 22*d* of the front splicer 22 and the protrusion 23*d* of the back splicer 23, which are described above. The automatic splicer 20 can thereby be disposed immediately upstream of the bag-making and packaging unit 5.

The conveying mechanism 30 is configured from rollers 30*a*, 30*b*, 30*c*, and other components as shown in FIG. 5, and the conveying mechanism 30 conveys the film F to the bag-making and packaging unit 5 disposed downstream.

The pinch roller 35 is disposed downstream of the rollers 30*a* to 30*c* as shown in FIG. 5. The pinch roller 35 is configured from two rollers 35*a*, 35*b* which oppose each other. The two rollers 35*a*, 35*b* are disposed so as to be capable of moving toward and away from each other. The two rollers 35*a*, 35*b* support the film F when near to each other (hereinafter shown as a closed state) and retreat to a position not in contact with the film F when separated from each other (hereinafter shown as an open state).

A first encoder (fed amount measuring unit) 36 is attached to the roller 35*a* (see FIG. 7). The first encoder 36 calculates the fed amount of the film F on the basis of the rotation of the roller 35*a*. The controller 10, described hereinafter, calculates the conveying speed of the film F on the basis of the fed amount calculated by the first encoder 36.

The tension roller 40 is disposed downstream of the pinch roller 35 as shown in FIG. 7. The tension roller 40 applies a specified amount of tensile force to the film F, whereby the tensile force applied to the film F is measured. For example, the tension roller 40 can maintain a specified amount of tensile force by switching the rotational speeds of the rollers of the conveying mechanism 30 feeding the film F. The tension roller 40 includes a first guide roller 41 and a second guide roller 42 for changing the conveying angle of the film F, as well as a dancer roller 43 and a second encoder 51.

Figure 8:
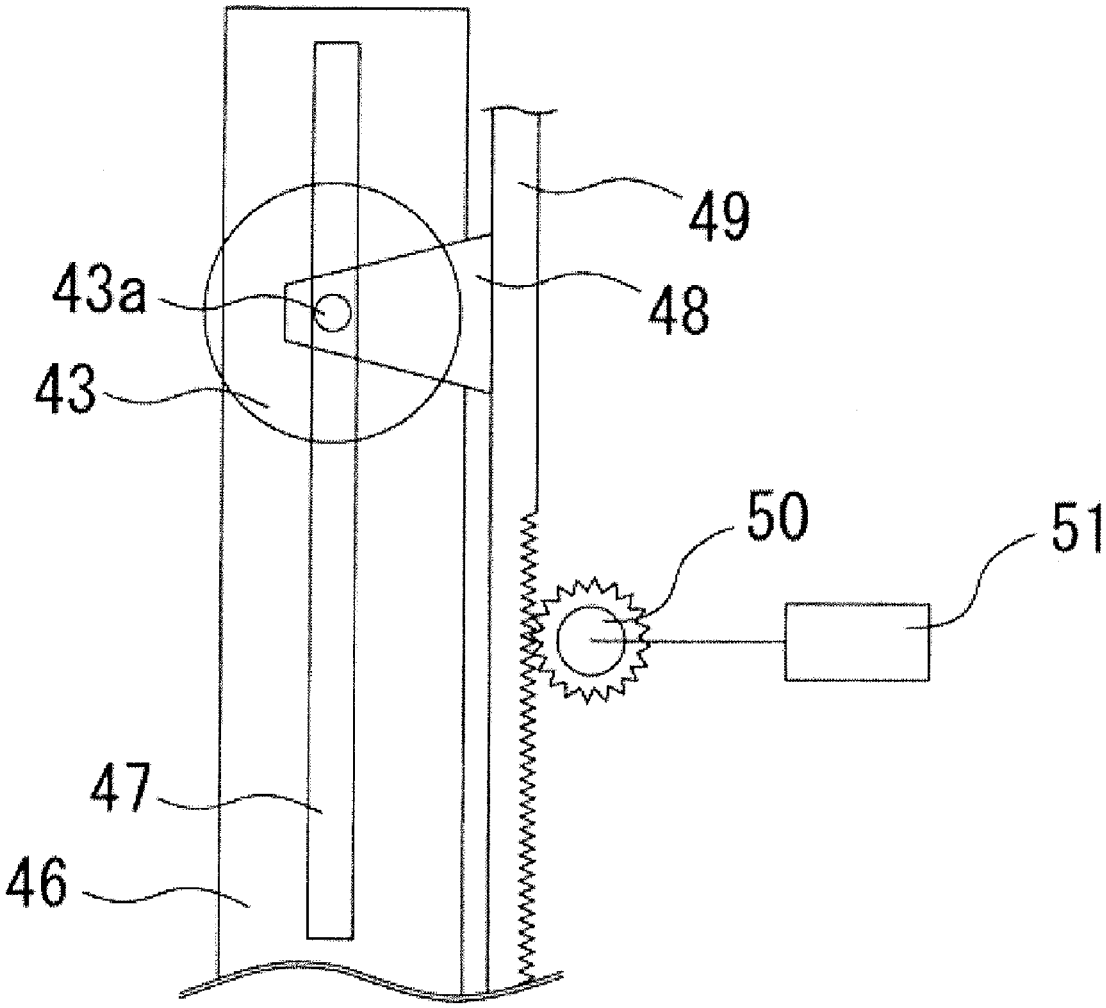
FIG. 8 is a front view showing an example of the configuration of a tension roller included in the film supply unit of FIG. 4.

The dancer roller 43 has shafts 43*a* at both ends. A pair of left and right guide plates 46 are disposed at the ends of the dancer roller 43. Guide slits 47 extending vertically are formed in the pair of left and right guide plates 46. The shafts 43*a* of the dancer roller 43 are inserted through and supported in the guide slits 47 as shown in FIG. 8. The dancer roller 43 thereby has a configuration capable of moving vertically. Detection means is also provided in order to detect the amount of vertical displacement of the dancer roller 43. In the example in FIG. 8, a vertically extending rack 49 is used as the detection means. The rack 49 is attached via a bracket 48 to the shaft 43*a* of the dancer roller 43 protruding from the guide slit 47 of the guide plate 46. A constantly meshed pinion 50 is mounted on the rack 49. The pinion 50 is rotatably mounted to a frame (not shown). The second encoder 51 is attached to the pinion 50. The second encoder 51 detects the amount of vertical displacement of the dancer roller 43 corresponding to the amount of rotation of the pinion 50. It is thereby possible to observe the tensile force applied to the film F, for example, on the basis of the amount of vertical displacement.

Description of Control Region

The controller 10 has a last end detection unit 10*a* and a vacuum-degree control unit 10*b*, as shown in FIG. 7. The controller 10 is connected with a storage unit 71, the liquid crystal display 8, the operating switches 7, the vacuum pump 72, a vacuum-degree detector (vacuum-degree detection unit) 73, and other components. The vacuum pump 72 suctions air out of the inside of the air intake box 14*d* and creates negative pressure inside the air intake box 14*d*. The vacuum-degree detector 73 detects the degree of vacuum inside the air intake box 14*d*. The storage unit 71 stores the fed amount, conveying speed, and conveying time of the film F (the time required in order to convey a predetermined length of the film F); as well as the degree of vacuum detected by the vacuum-degree detector 73, various setting values inputted in advance using the operating switches 7, and other various pieces of information.

The controller 10 performs various controls for appropriately operating the combination weighing system 1, including (1) controls for the shaft drive parts 19*a*, 19*b*, the pinch roller 35, the conveying mechanism 30, the dancer roller 43, and other drive regions, (2) a control for reading the information stored in the storage unit 71, (3) a control for displaying a message on the liquid crystal display 8, (4) a control for storing the information inputted from the operating switches 7 in the storage unit 71, and the like. Particularly, the last end detection unit 10*a* and the vacuum-degree control unit 10*b* perform controls such as those described below.

The last end detection unit 10*a* and the vacuum-degree control unit 10*b* are described hereinbelow.

The last end detection unit 10*a* is connected with the shaft drive parts 19*a*, 19*b*, the pinch roller 35, the conveying mechanism 30, the dancer roller 43, and other drive regions. The last end detection unit 10*a* performs controls on the aforementioned drive regions and adjusts the fed amount of the film F. Based on the information on the fed amount of the film F detected by the register mark sensor 21 and the second encoder 51, the last end detection unit 10*a* also performs positioning and other controls for joining together the last end area of the film F of the supplying film roll FR1 and the starting end area of the film F of the backup film roll FR2 in the automatic splicer 20. Specifically, the last end detection unit 10*a* observes the tensile force applied to the film F from a position in the vertical direction of the dancer roller 43. The last end detection unit 10*a* also detects the last end of the supplying film roll FR1 from the change in tensile force. Furthermore, the last end detection unit 10*a* controls the shaft drive part 19*a* and rotates the shaft 18*a* so that the film F is wound a predetermined length beginning at the point in time when the register mark sensor 21 detects the register marks M. The time of detection of the last end of the film roll FR1 referred to herein is the detection of the instant when the film F can no longer be further fed out from the film roll FR1 and the shaft 18*a* can no longer rotate. The last end detection unit 10*a* may also determine the last end of the film roll FR1 by detecting that the tensile force applied to the dancer roller 43 has temporarily increased, for example.

The vacuum-degree control unit 10*b* includes an inverter (not shown) for internally performing PID calculations. The vacuum-degree control unit 10*b* is also connected to the vacuum pump 72 and the vacuum-degree detector 73. With this type of configuration, the vacuum-degree control unit 10*b* receives the degree of vacuum values of the air intake box 14*d* detected by the vacuum-degree detector 73. The vacuum-degree control unit 10*b* suitably controls the operation of the vacuum pump 72 via the inverter while cooperating with the last end detection unit 10*a*. The controlling of the vacuum pump 72 by the vacuum-degree control unit 10*b* is referred to as degree of vacuum control. The vacuum-degree control unit 10*b* thereby controls the degree of vacuum of the air intake box 14*d* to a proper degree of vacuum. The term "proper degree of vacuum" used herein refers to a degree of vacuum inside the air intake box 14*d* at which the film F is conveyed so that the film conveying speed or the film conveying time after degree of vacuum control reaches a pre-set film conveying speed or a pre-set film conveying time before the degree of vacuum control, and the vacuum pump 72 is operated with minimum energy.

The details of the control by the vacuum-degree control unit 10*b* are described hereinbelow.

First, the vacuum pump 72 is operated at a specified output by the vacuum-degree control unit 10*b*, and the degree of vacuum inside the air intake box 14*d* is matched to a reference value that has been set in advance (a value stored in the storage unit 71). The term "reference value" herein refers to a degree of vacuum at which the film F can surely adhere by suction to the pull-down belt mechanism 14 and the desired amount of the film F can be conveyed, regardless of the surface state, material, and thickness of the film, the shape of the bag and other characteristics when the bag has been formed, as well as the environment (air temperature, humidity, etc.). Thus, the reference value may be set to a value larger than an actual vacuum degree required for conveying a particular film by including some safety margin.

Figure 9:
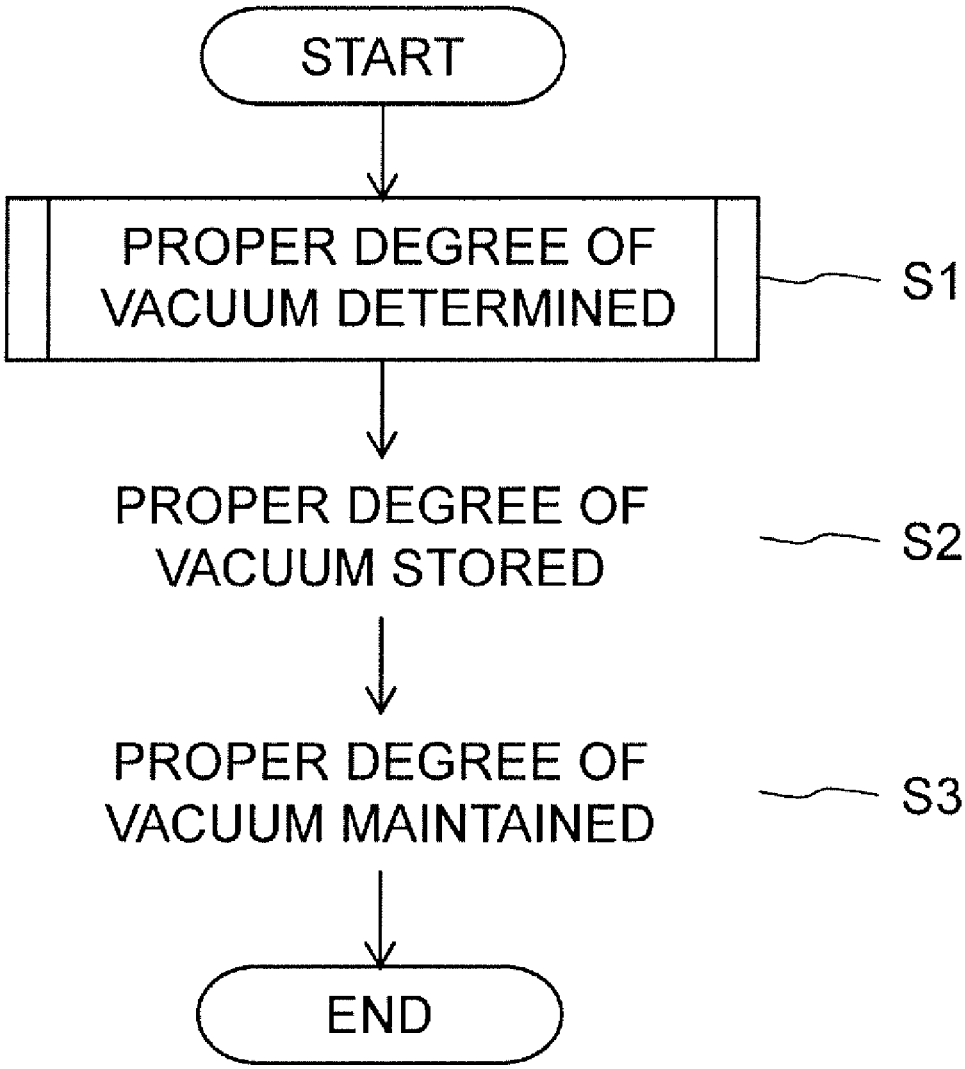
FIG. 9 is a flowchart showing an example of an algorithm for the procedure of a degree of vacuum control process of the pull-down belt mechanism (suction-type film conveyor) in the present embodiment.
Figure 10:
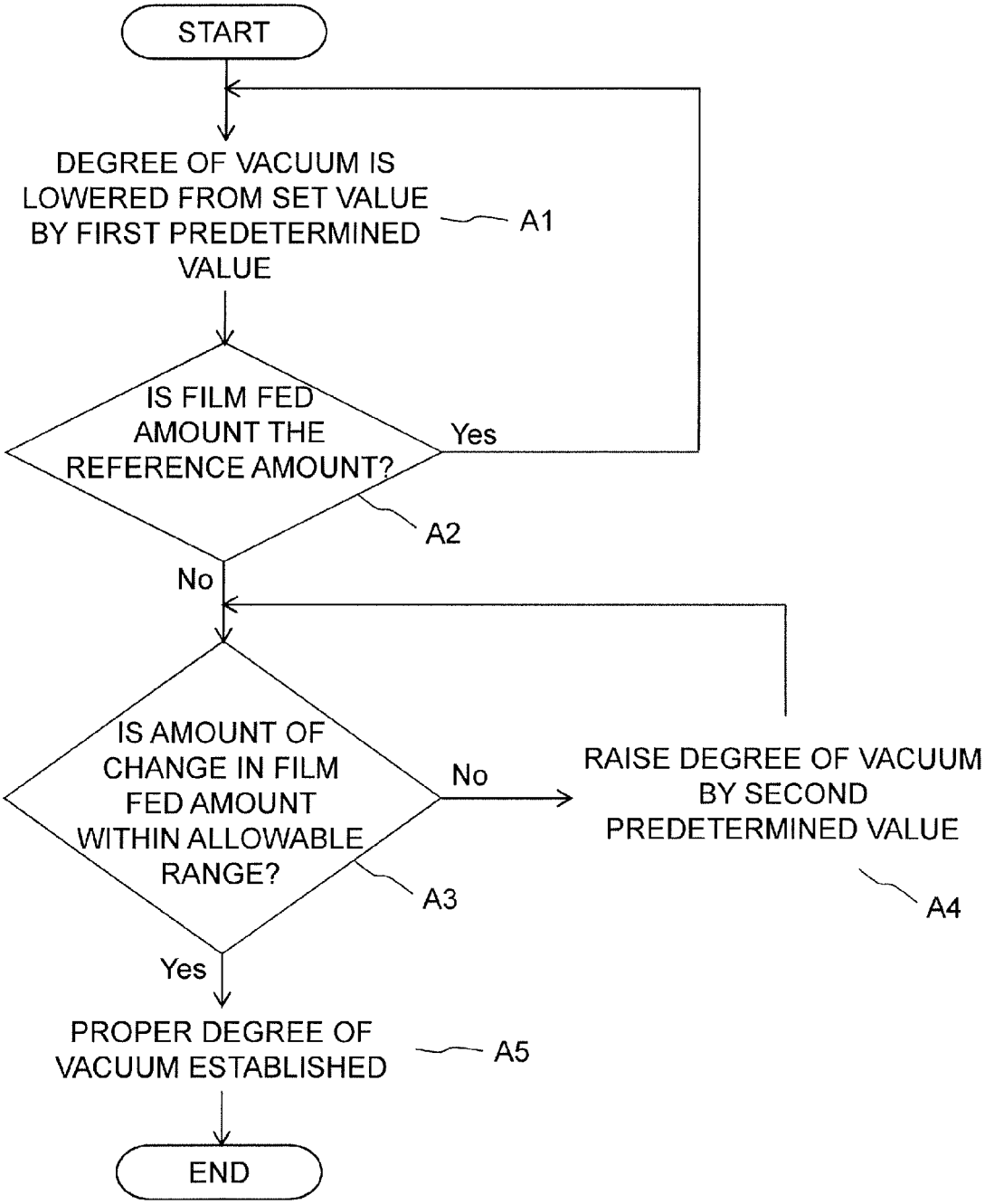
FIG. 10 is a flowchart showing an example of an algorithm for the procedure of a process for determining the proper degree of vacuum in FIG. 9.

Next, a process for determining the proper degree of vacuum is performed in step S1, as shown in FIG. 9. Therefore, with this operation in step S1, the vacuum—degree control unit 10*b* corresponds to a proper vacuum-degree determination section in this embodiment. The process for determining the proper degree of vacuum in step S1 is performed by the process sequence shown in FIG. 10. The initial degree of vacuum value set in the air intake box 14*d* is used as the reference value. That is, the value (the set value) set as the degree of vacuum of the air intake box 14*d* before degree of vacuum control is the reference value.

Specifically, in step A1, a process is performed for lowering the degree of vacuum inside the air intake box 14*d* from the set value by an amount equivalent to a first predetermined value. In other words, the degree of vacuum inside the air intake box 14*d* matched with the reference value is set to a value lower than the reference value. That is, the value resulting from lowering the reference value by a first predetermined value is the new set value. The term "first predetermined value" herein refers to a value that has been appropriately set during operation of the operating switches 7 or during shipping. The first predetermined value can be changed as necessary by operating the operating switches 7.

Next, in step A2, a decision is made as to whether or not the fed amount of the film F coincides with a reference amount. The term "reference amount" herein refers to the conveyed amount (conveyed length) of the film F per unit time. In the case that the fed amount of the film F coincides with the reference amount (step A2: Yes), the sequence returns to step A1 and the set value of the degree of vacuum inside the air intake box 14*d* is further reduced by the first predetermined value. In the case that the fed amount of the film F does not coincide with the reference amount (step A2: No), the sequence advances to step A3.

In step A3, a decision is made as to whether or not the amount of change in the film F is within an allowable range. The term "amount of change in the film F" herein refers to the difference between the fed amount of the film F and the reference amount, and is an amount indicating how far the fed amount of the film F has deviated from the reference amount. The term "allowable range" refers to the range of an allowable amount of change, and is the range of allowable error. In step A3, in the case that the amount of change in the film F is not within the allowable range (step A3: No), the sequence advances to step A4 and the set value of the degree of vacuum is raised by an amount equivalent to a second predetermined value. The term "second predetermined value" herein refers to a value that is less than the first predetermined value described above. The second predetermined value is a value set during operation of the operating switches 7 or during shipping, for the purpose of making fine adjustments. The second predetermined value can be changed as necessary by operating the operating switches 7. When the set value of the degree of vacuum is raised in proportion to the second predetermined value in step A4, the sequence then returns to step A3, and the determination is again made as to whether or not the amount of change in the film F is within the allowable range. In the case that the amount of change is within the allowable range in step A3 (step A3: Yes), the degree of vacuum detected at this time is established as the "proper degree of vacuum" (step A5), and the process for detecting the proper degree of vacuum is ended.

After step S1 described above, in step S2 shown in FIG. 9, the proper degree of vacuum is stored in the storage unit 71. After step S2, in step S3, the proper degree of vacuum stored in the storage unit 71 is maintained. Specifically, the degree of vacuum inside the air intake box 14*d* is detected at predetermined time intervals by the vacuum-degree detector 73 and stored in the storage unit 71. Based on information on the detected degree of vacuum and information on the proper degree of vacuum described above, the vacuum-degree control unit 10*b* controls the operation of the vacuum pump 72 and maintains the degree of vacuum of the air intake box 14*d* at the proper degree of vacuum. Thus, with this operation in step S3, the vacuum-degree control unit 10*b* corresponds to the vacuum-degree control section in this embodiment.

According to the present embodiment, the degree of vacuum inside the air intake box 14*d* is controlled so that the error between the length of the film F detected by the last end detection unit 10*a* and the length of the film F stored in the storage unit 71 falls within the allowable range. In other words, the degree of vacuum is controlled so that the error between the length of the film F actually conveyed and the length of the film F that should be conveyed falls within the allowable range. Based on the reference value of the degree of vacuum, the degree of vacuum inside the air intake box 14*d* detected by the vacuum-degree detector 73, and the proper degree of vacuum determined by the vacuum-degree control unit 10*b*, the degree of vacuum inside the air intake box 14*d* is set to the proper degree of vacuum, and the degree of vacuum inside the air intake box 14*d* is kept at the proper degree of vacuum. Specifically, the degree of vacuum inside the air intake box 14*d* is lowered from the pre-established reference value to the proper degree of vacuum and is kept at the proper degree of vacuum. The electric power for operating the vacuum pump 72 can thereby be greatly reduced. In other words, the total energy used in the operation of the packaging machine 3 can be reduced to a far greater extent than in conventional practice.

The detection of the register marks printed on the film F using the register mark sensor 21 makes it possible not only to position the film F, but also to reliably detect the conveying speed of the film F while it is being conveyed, as well as the conveying time of the film F in predetermined length increments in the conveying direction. Particularly, since the conveying speed of the film F and the conveying time of the film F can be reliably detected, it is possible to detect when the film F slips relative to the pull-down belt mechanism 14. When the film F is detected to have slipped relative to the pull-down belt mechanism 14, possible solutions include, for example, temporarily stopping the operation of the packaging machine 3, controlling the conveying of the film F so that conveying returns to its usual state, and controlling the output of the vacuum pump 72 so that the output increases.

EXAMPLES

Example 1

Using a packaging machine (ATLA S202 (made by Ishida Co., Ltd.)) having the same configuration as the packaging machine 3 described above, the manner of change in power consumption was measured with and without degree of vacuum control in the air intake box. The films provided for the experiment were a thick film 1, a corner-forming film, and a 12-inch film. The thick film 1 was 340 mm wide, 80 μm thick, and composed of four layers. The corner-forming film was 380 mm wide, 55 μm thick, and composed of three layers. The 12-inch film was 545 mm wide, 70 μm thick, and composed of three layers. A PPX-RO1NH-M (made by CKD Corporation) was used as a vacuum pressure sensor, and a 3G3JX-A2015 (made by Omron Corporation) was used as an inverter.

The degree of vacuum inside the air intake box was controlled so as to reach the "proper degree of vacuum." Specifically, the packaging machine was operated without performing degree of vacuum control beforehand, and the conveyed amount of the film F was stored. Furthermore, the degree of vacuum inside the air intake box was set to a specific value while the set value of the degree of vacuum inside the air intake box was progressively lowered by increments of the first predetermined value from the reference value. The specific value is a value which makes it possible to convey the film F to the same extent as prior to degree of vacuum control and to let the operation energy of the vacuum pump 72 reach a minimum. The reference value is the value of the degree of vacuum inside the air intake box resulting from the vacuum pump being operated at a constant frequency (60 Hz in this case). The reference value herein is −50 kPa (G) (51.33 kPa (abs)).

The following Table 1 shows the "types of films" provided for the experiment, the "bag length (set value)" and "bag width (set value)" that are the target values for the bag obtained by forming the film into a bag, the "operating speed" and "film conveying speed" of the packaging machine, and the "bag length average" of the bags actually produced (100 bags).

TABLE 1

| Film | Degree Of Vacuum Control | Operating Speed (bpm) | Bag Length (Set Value) (mm) | Bag Width (Set Value) (mm) | Film Conveying Speed (m/min) | Bag Length Average (mm) |
|---|---|---|---|---|---|---|
| Thick Film 1 | Yes | 160 | 197 | 127 | 31.5 | 195.2 |
| | No | | | (5 in) | | 195.0 |
| Corner-Forming Film | Yes | 100 | 318 | 178 | 31.8 | 313.8 |
| | No | | | (7 in) | | 314.0 |
| 12-Inch Film | Yes | 80 | 255 | 305 | 20.4 | 253.3 |
| | No | | | (12 in) | | 253.6 |

Figure 11:
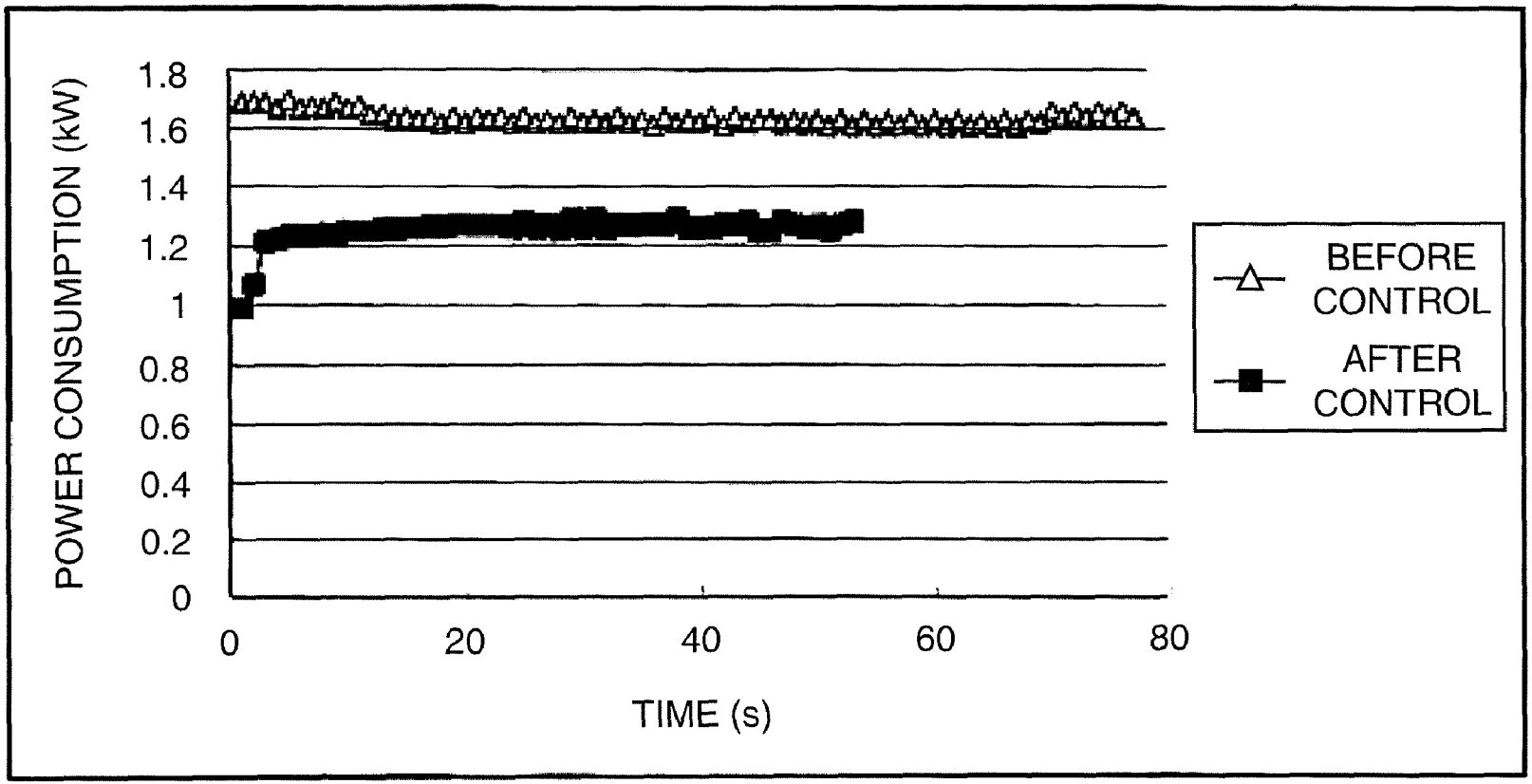
FIG. 11 is a graph showing the change over time in the power consumption of a vacuum pump when degree of vacuum control has been performed in an air intake box and the change over time in the power consumption of a vacuum pump when degree of vacuum control has not been performed, in a case in which a thick film 1 is used in Example 1.
Figure 12:
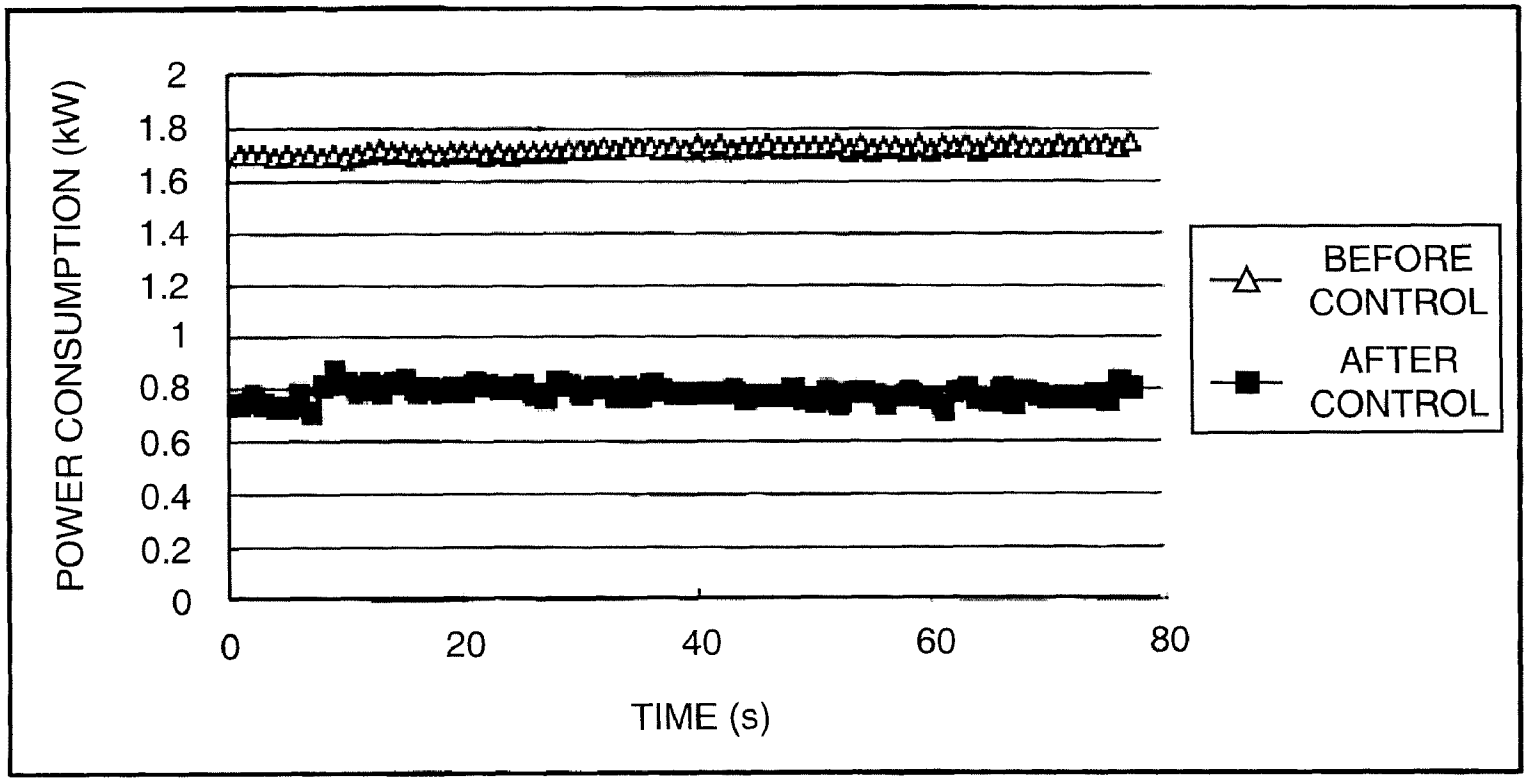
FIG. 12 is a graph showing the change over time in the power consumption of a vacuum pump when degree of vacuum control has been performed in an air intake box and the change over time in the power consumption of a vacuum pump when degree of vacuum control has not been performed, in a case in which a corner-forming film is used in Example 1.
Figure 13:
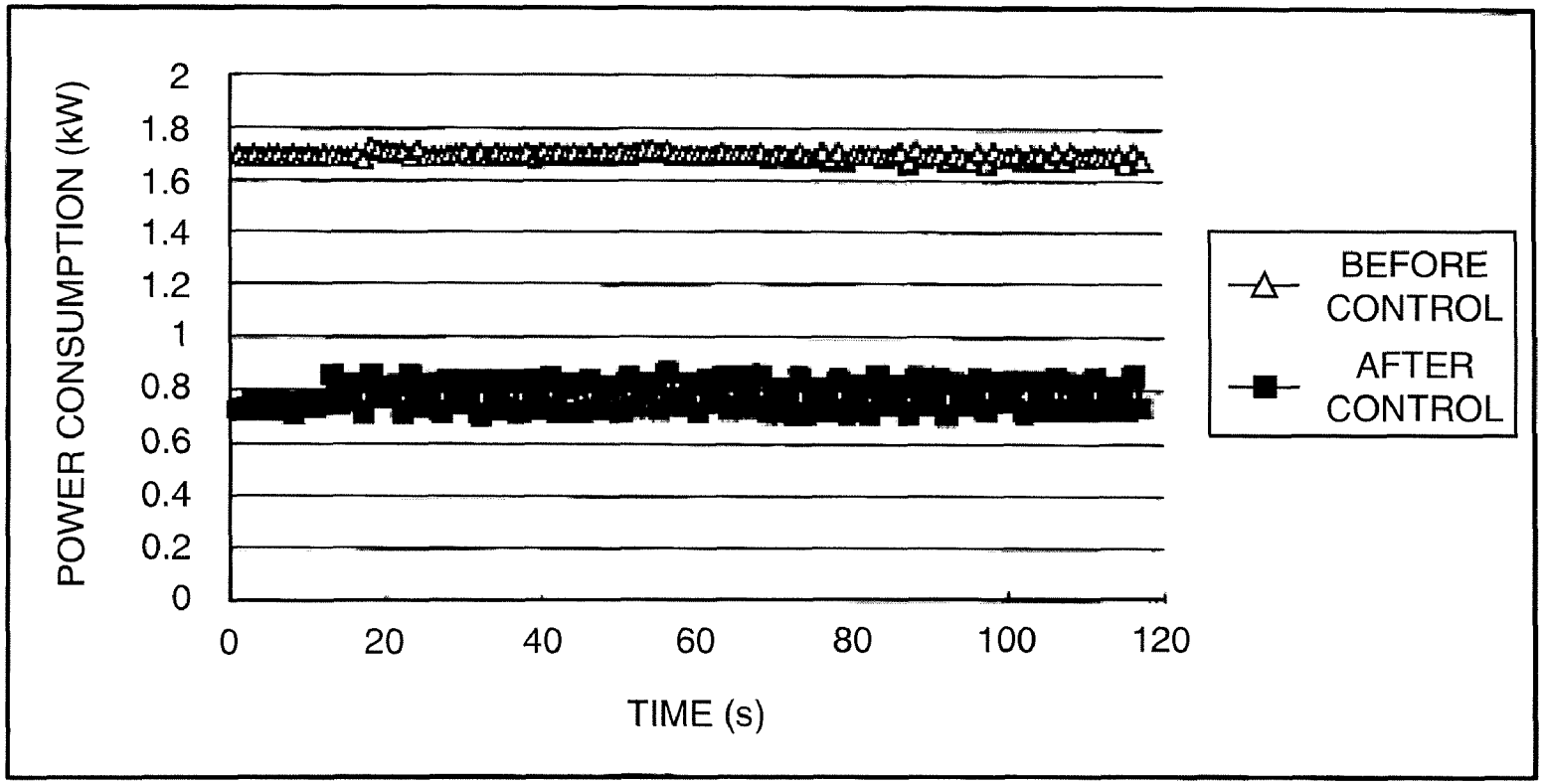
FIG. 13 is a graph showing the change over time in the power consumption of a vacuum pump when degree of vacuum control has been performed in an air intake box and the change over time in the power consumption of a vacuum pump when degree of vacuum control has not been performed, in a case in which a 12-inch film is used in Example 1.

FIGS. 11, 12, and 13 show the change over time in power consumption of the vacuum pump when degree of vacuum control is performed inside the air intake box, as well as the change over time in power consumption of the vacuum pump when degree of vacuum control is not performed, under the conditions described above. FIG. 11 shows the change over time in power consumption when the thick film 1 is used. FIG. 12 shows the change over time in power consumption when the corner-foaming film is used. FIG. 13 shows the change over time in power consumption when the 12-inch film is used. It can be seen from FIG. 11 that the power consumption of the vacuum pump when degree of vacuum control is performed is reduced by approximately 75% in comparison with the power consumption of the vacuum pump when degree of vacuum control is not performed. It can be seen from FIGS. 12 and 13 that the power consumption of the vacuum pump when degree of vacuum control is performed is reduced by approximately 50% in comparison with the power consumption of the vacuum pump when degree of vacuum control is not performed.

Figure 14:
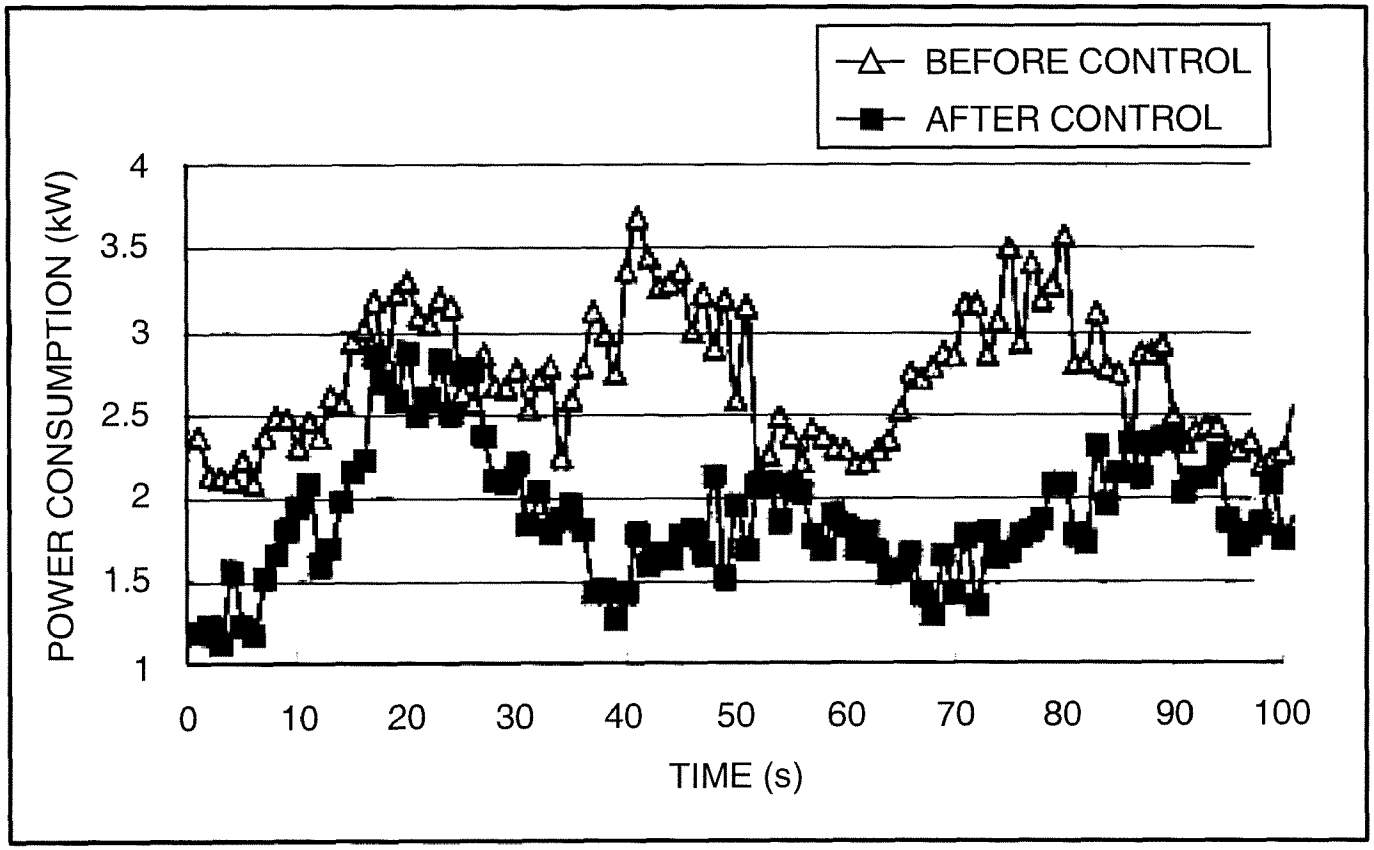
FIG. 14 is a graph showing the change over time in the power consumption of the entire machine when degree of vacuum control has been performed in an air intake box and the change over time in the power consumption of the entire machine when degree of vacuum control has not been performed, in a case in which a corner-forming film is used in Example 1.

FIG. 14 also shows the change over time in the power consumption of the entire packaging machine when degree of vacuum control is performed inside the air intake box, as well as the change over time in the power consumption of the entire packaging machine when degree of vacuum control is not performed, under the conditions described above. FIG. 14 shows the change over time in the power consumption of the entire packaging machine when the corner-forming film is used. It can be seen from FIG. 14 that the power consumption of the entire packaging machine when degree of vacuum control is performed is reduced by approximately 75% in comparison with the power consumption of the entire packaging machine when degree of vacuum control is not performed. Power-consuming regions other than the vacuum pump include the heater used in order to seal the film, the motor serving as the motive power for conveying the film, the liquid crystal display, and other devices. The same applies for Example 2 described hereinafter.

The bag length average value of the bags produced was substantially the same result for both the case of performing degree of vacuum control and the case of not performing degree of vacuum control in the packaging machine of the present example, as shown in Table 1. Therefore, the packaging machine of the present example can convey the film and make bags in the same manner as a conventional packaging machine, regardless of the fact that the power consumption can be reduced to a far greater extent than in a conventional packaging machine. There is a difference between the "bag length (set value)" and the "bag length average" in Table 1, but the difference is within the allowable range.

Example 2

Concerning the system pertaining to the degree of vacuum control, a packaging machine (ASTRO-S101R (made by Ishida Co., Ltd.)) having the same configuration as the packaging machine of Example 1 described above was used, and the manner of change of the power consumption was measured with and without degree of vacuum control in the air intake box. The films provided for the experiment were a thin film and a thick film 2. The thin film was 295 mm wide, 40 μm thick, and was composed of two layers. The thick film 2 was 280 mm wide, 70 μm thick, and was composed of five layers. The same vacuum pressure sensor and inverter of Example 1 were used. The degree of vacuum inside the air intake box was controlled so as to be the "proper degree of vacuum." Specifically, the packaging machine was operated in advance without performing degree of vacuum control, and the conveyed amount of the film F was stored. Furthermore, the degree of vacuum inside the air intake box was set to a specific value while the set value of the degree of vacuum inside the air intake box was progressively lowered by increments of the first predetermined value from the reference value. The specific value is a value which makes it possible to convey the film F to the same extent as prior to degree of vacuum control and to let the operation energy of the vacuum pump 72 reach a minimum. The reference value is the value of the degree of vacuum inside the air intake box resulting from the vacuum pump being operated at a constant frequency (60 Hz in this case). The reference value herein is −50 kPa (G) (51.33 kPa (abs)).

The following Table 2 shows the "types of films" provided for the experiment, the "bag length (set value)" and "bag width (set value)" that are the target values for the bag obtained by forming the film into a bag, the "operating speed" and "film conveying speed" of the packaging machine, and the "bag length average" of the bags actually produced (100 bags).

TABLE 2

| Film | Degree Of Vacuum Control | Operating Speed (bpm) | Bag Length (Set Value) (mm) | Bag Width (Set Value) (mm) | Film Conveying Speed (m/min) | Bag Length Average (mm) |
|---|---|---|---|---|---|---|
| Thin Film | Yes | 70 | 177 | 127 | 37.5 | 174.8 |
| | No | | | (5 in) | | 174.0 |
| Thick Film 2 | Yes | 70 | 190 | 127 | 40.3 | 188.5 |
| | No | | | (5 in) | | 188.7 |

Figure 15:
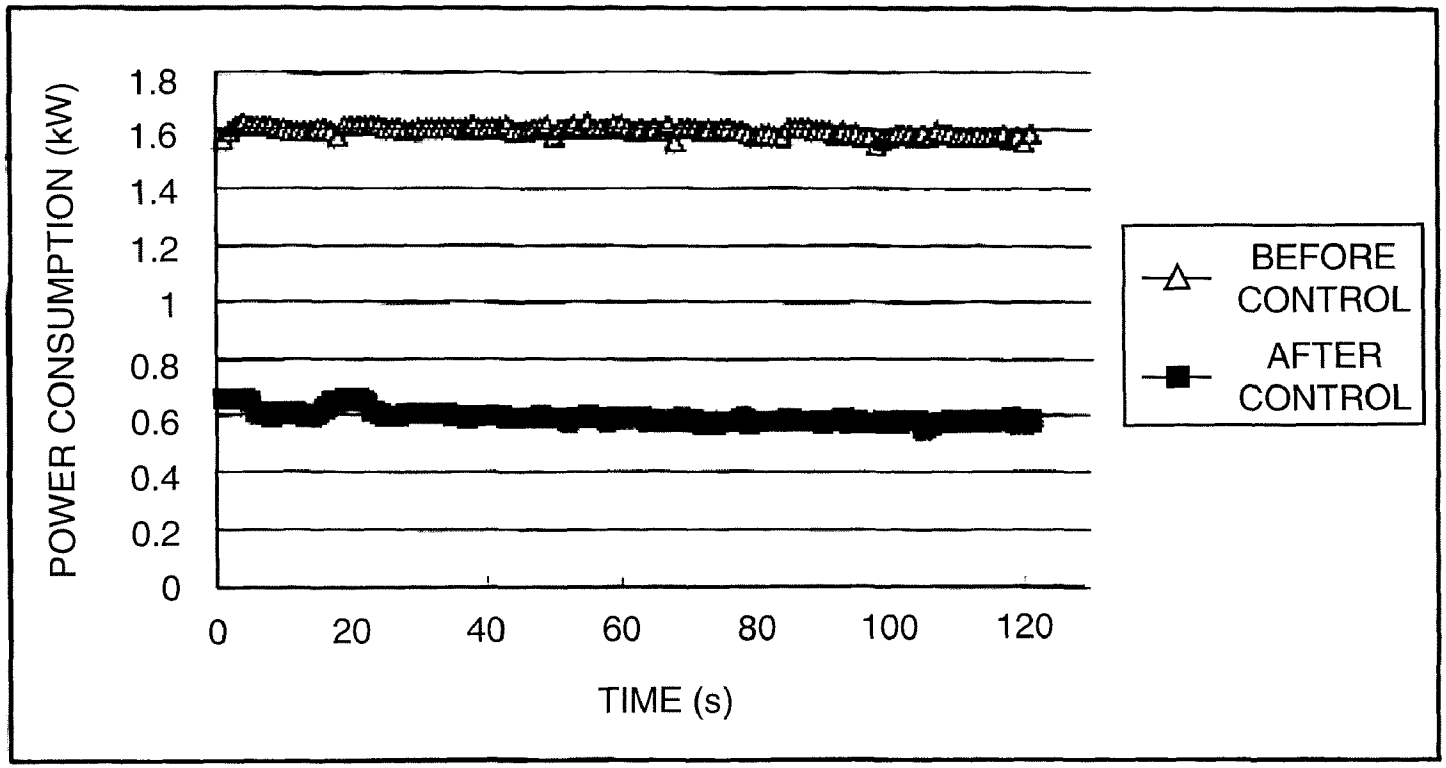
FIG. 15 is a graph showing the change over time in the power consumption of a vacuum pump when degree of vacuum control has been performed in an air intake box and the change over time in the power consumption of a vacuum pump when degree of vacuum control has not been performed, in a case in which a thin film is used in Example 2.
Figure 16:
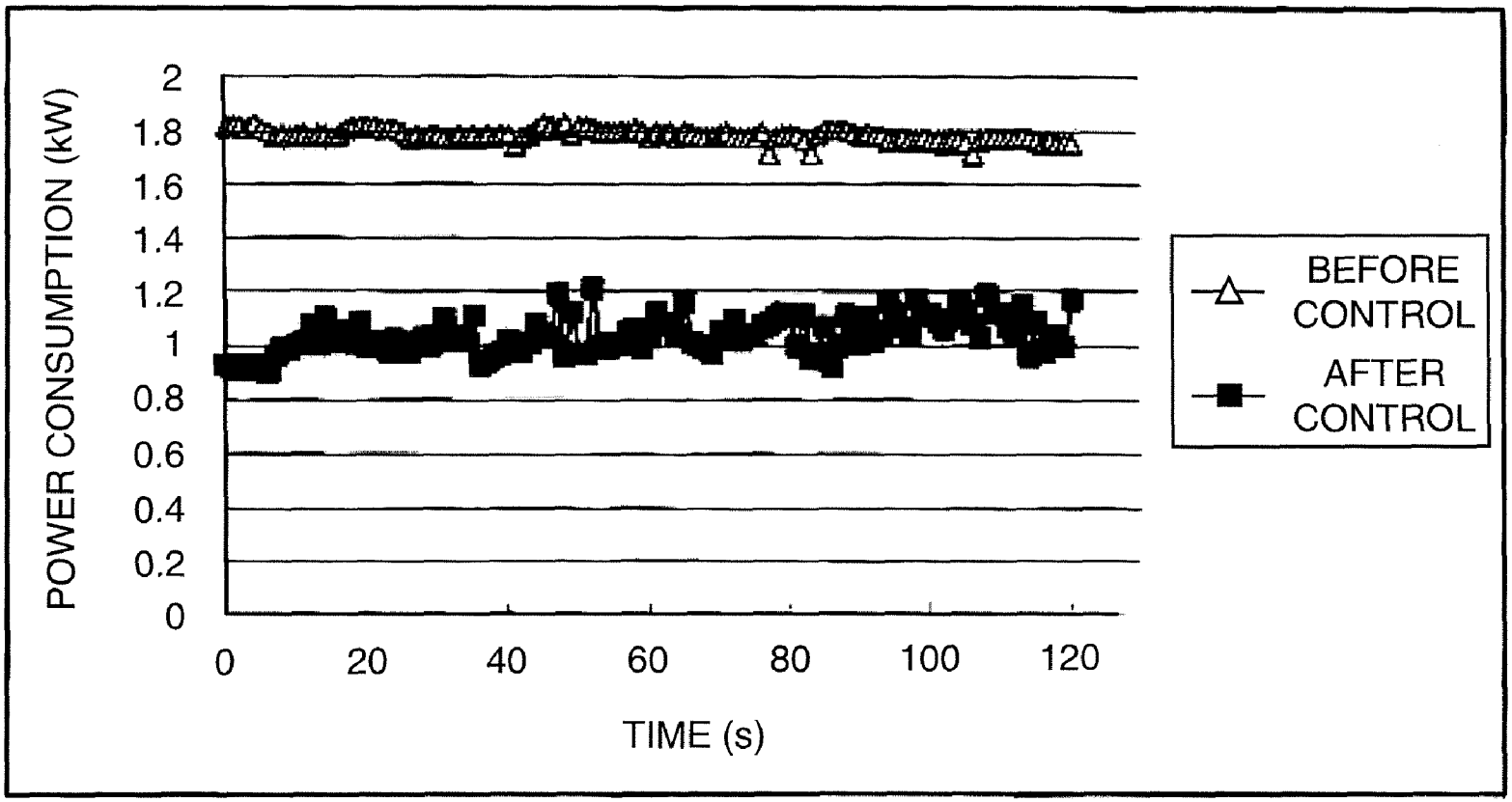
FIG. 16 is a graph showing the change over time in the power consumption of a vacuum pump when degree of vacuum control has been performed in an air intake box and the change over time in the power consumption of a vacuum pump when degree of vacuum control has not been performed, in a case in which a thick film 2 is used in Example 2.

FIGS. 15 and 16 show the change over time in power consumption of the vacuum pump when degree of vacuum control is performed inside the air intake box, as well as the change over time in power consumption of the vacuum pump when degree of vacuum control is not performed, under the conditions described above. FIG. 15 shows the change over time in power consumption when the thin film is used, and FIG. 16 shows the change over time in power consumption when the thick film 2 is used. It can be seen from FIG. 15 that the power consumption of the vacuum pump when degree of vacuum control is performed is reduced by approximately 60% in comparison with the power consumption of the vacuum pump when degree of vacuum control is not performed. It can be seen from FIG. 16 that the power consumption of the vacuum pump when degree of vacuum control is performed is reduced by approximately 40% in comparison with the power consumption of the vacuum pump when degree of vacuum control is not performed.

Figure 17:
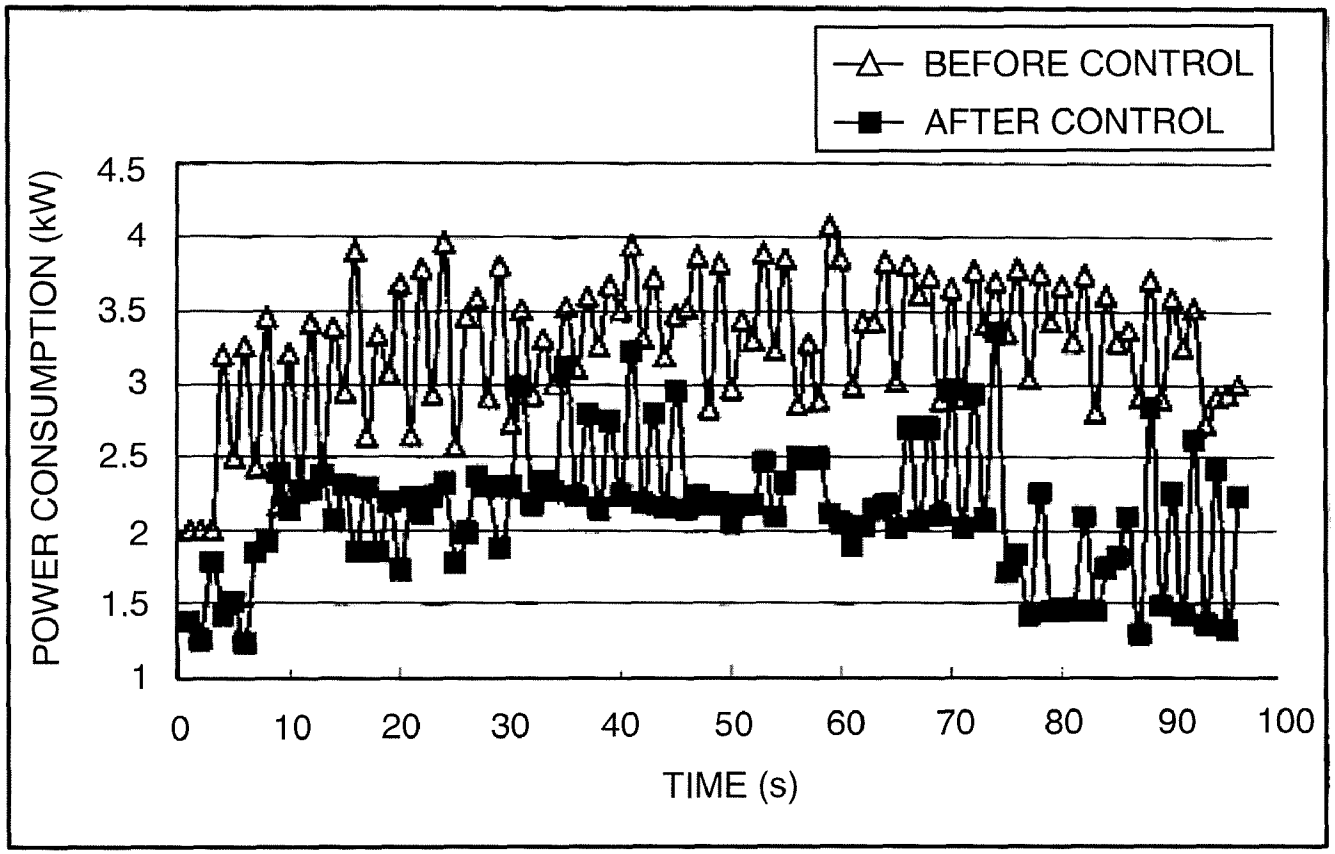
FIG. 17 is a graph showing the change over time in the power consumption of the entire machine when degree of vacuum control has been performed in an air intake box and the change over time in the power consumption of the entire machine when degree of vacuum control has not been performed, in a case in which a thick film 2 is used in Example 2.

FIG. 17 also shows the change over time in the power consumption of the entire packaging machine when degree of vacuum control is performed inside the air intake box, as well as the change over time in the power consumption of the entire packaging machine when degree of vacuum control is not performed, under the conditions described above. FIG. 17 shows the change over time in the power consumption of the entire packaging machine when the thick film 2 is used. It can be seen from FIG. 17 that the power consumption of the entire packaging machine when degree of vacuum control is performed is reduced by approximately 75% in comparison with the power consumption of the entire packaging machine when degree of vacuum control is not performed.

The average bag length of the bags produced was substantially the same result for both the case of performing degree of vacuum control and the case of not performing degree of vacuum control in the packaging machine of the present example, as shown in Table 2. Therefore, the packaging machine of the present example can convey the film and make bags in the same manner as a conventional packaging machine, regardless of the fact that the power consumption can be reduced to a far greater extent than in a conventional packaging machine. There is a difference between the "bag length (set value)" and the "bag length average" in Table 2, but the difference is within the allowable range.

MODIFICATIONS (1) The design of the present invention can be varied within a range that does not deviate from the scope of the claims, and the present invention is not limited to the embodiments or examples described above.

(2) For example, stored in the storage unit 71 are condition information pertaining to at least one condition from a plurality of conditions including the surface state, material, and thickness of the film F, as well as the shape of the bag when the bag is produced; and information on the proper degree of vacuum determined in advance under conditions corresponding to the aforementioned condition information. Conditions including the current surface state, material, and thickness of the film F, as well as the shape of the bag when the bag is produced are automatically identified by the vacuum-degree control unit 10*b* every time operation of the packaging machine 3 is started. Condition information matching the current conditions is also determined from the pieces of condition information stored in the storage unit 71. Based on the condition information matching the current conditions, the degree of vacuum control may automatically perform control for lowering the set value from the reference value to the proper degree of vacuum. The current conditions including the film F and/or the shape of the bag may be automatically identified by a sensor or the like, or they may be manually inputted by operating the operating switches 7.

(3) Determination of the "proper degree of vacuum" described above is performed during a temporary operation which occurs either before the packaging machine is shipped or after the packaging machine is installed on-site, and this determination may be designed so as to enable the packaging machine to be used with less electric power than a conventional packaging machine when the main operation is initiated. Determination of the "proper degree of vacuum" may also be performed during the main operation, and may be designed so as to enable the packaging machine to be used with less electric power than a conventional packaging machine after determination of the "proper degree of vacuum" has been performed.

(4) In the embodiment described above, the proper degree of vacuum was specified by progressively lowering the set value in increments of the first predetermined value, but another possibility is to store a plurality of degrees of vacuum in advance in the storage unit 71, and to specify the proper degree of vacuum by changing to any of the stored degrees of vacuum. Specifically, it is acceptable if the degree of vacuum inside the air intake box can be changed to a degree of vacuum stored in the storage unit 71 by operating the operating switches 7. Particularly, the degree of vacuum inside the air intake box may be varied to a previously set degree of vacuum by a one-touch operation using buttons or the like in the operating switches 7.

(5) The "proper degree of vacuum" may be configured so as to be automatically determined by the vacuum-degree control unit 10*b* at constant time intervals, or configured so as to be suitably determined manually. Another possibility is for the vacuum pump 72 to be controlled by the vacuum-degree control unit 10*b* every time determination of the "proper degree of vacuum" is complete, so that the degree of vacuum inside the air intake box 14*d* matches a newly determined proper degree of vacuum.

(6) In the embodiment and examples described above, an example is presented in which the process for determining the "proper degree of vacuum" is performed once by the vacuum-degree control unit 10*b*. The average value of the "proper degree of vacuum" may instead be used as the "proper degree of vacuum" used in the actual control. Specifically, the "proper degree of vacuum" is repeatedly determined multiple times, and the determined degrees of vacuum are used as "temporary proper degrees of vacuum." An average value may be calculated based on the obtained plurality of "temporary proper degrees of vacuum," and the average value may be used as the "proper degree of vacuum" used in the actual control.

Additionally, the moving average of the "proper degree of vacuum" may be used as the "proper degree of vacuum" used in the actual control. Specifically, the "proper degree of vacuum" is determined by the vacuum-degree control unit 10*b* at constant time intervals, and the determined degrees of vacuum are used as the "temporary proper degrees of vacuum." The moving average value is calculated based on the plurality of "temporary proper degrees of vacuum" obtained at the constant time intervals.

(7) Furthermore, in the embodiment described above, the conveying speed of the film F was calculated based on the fed amount calculated by the first encoder 36, but the conveying speed of the film F may also be calculated based on information obtained by a camera. For example, the register marks of the film F may be identified by a camera, and the conveying speed of the film F may be calculated based on the time intervals at which the register marks are identified.

(8) The vacuum-degree detector (vacuum pressure sensor) 73 may be disposed in any location as long as it is in a position where it can measure the degree of vacuum inside the air intake box. For example, instead of the interior of the air intake box, the vacuum-degree detector 73 may be installed inside an air intake pipe connecting the vacuum pump 72 and the air intake box, in the connecting portion between the air intake box and an air intake pipe, or in the connecting portion between the vacuum pump 72 and the air intake pipe. In other words, the degree of vacuum of the air intake box may simply be the value detected by the vacuum-degree detector 73, or an estimated value obtained by processing or correcting the value detected by the vacuum-degree detector 73.

(9) The reference value of the degree of vacuum may be changed according to the type (material and other characteristics) of the pull-down belt mechanism 14. Furthermore, the extent by which the reference value is lowered may also be changed according to the type of the pull-down belt mechanism 14.

(10) The suction control apparatus according to the embodiment described above was applied to a case in which the cylindrical film F was conveyed downward while both sides of the cylindrical film F were held by suction by two pull-down belt mechanisms 14, 14. However, the suction control apparatus can also be applied to a case in which the film F is conveyed downward while a single location of the film F is held by suction by one pull-down belt mechanism 14.

To reliably suction and convey the cylindrical film F in cases in which the film F is suctioned and conveyed by one pull-down belt mechanism 14, it is common to set the degree of vacuum of the air intake box to an extremely high value. On the other hand, in cases in which the film F is suctioned and conveyed by two pull-down belt mechanisms 14, 14, there is no need to set the degree of vacuum of the air intake box to a high value because the cylindrical film F is suctioned from both sides. Therefore, in cases in which one pull-down belt mechanism 14 is used, there is a tendency for the power consumption of the vacuum pump 72 to be higher than in cases in which two pull-down belt mechanisms 14, 14 are used.

However, the power consumption of the vacuum pump 72 can be reduced without compromising the conveyed state of the film F by using the suction control apparatus according to the embodiment described above. It is thereby possible to effectively reduce the power consumption of a packaging machine which the film F is conveyed by a single pull-down belt mechanism 14.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A suction control apparatus adapted to be used in a packaging machine for conveying and packaging a belt-shaped film while the film is being suctioned by a suction-type film conveyor, the suction control apparatus comprising:

an air intake box with an air intake opening;

a conveying belt arranged adjacent to the air intake box, the conveying belt having plurality of air intake holes;

a vacuum-degree determination section configured and arranged to determine a proper degree of vacuum of the suction-type film conveyor, which is less than a reference value set in advance, such that the film is drawn toward the conveying belt in response to the proper degree of vacuum being applied to the air intake box; and a vacuum-degree control section configured to set the degree of vacuum to a first value corresponding to the proper degree of vacuum determined by the proper vacuum-degree determination section.

2. The suction control apparatus according to claim 1, further comprising a conveying state detection section configured and arranged to detect a speed at which the film is conveyed or a conveying time required for a predetermined length of the film to be conveyed, and a storage section configured and arranged to store a set speed value for the conveying speed or a set time value for the conveying time, the vacuum-degree control section being further configured to adjust the degree of vacuum so that the conveying speed falls within a predetermined range with respect to the set speed value, or so that the conveying time falls within a predetermined range with respect to the set conveying time value.

3. The suction control apparatus according to claim 2, wherein the conveying state detection section includes a register mark sensor configured and arranged to detect a register mark printed on the film.

4. The suction control apparatus according to claim 1, wherein the vacuum-degree control section is configured to lower the degree of vacuum from the reference value to the first value on the basis of condition information pertaining to at least one condition among a plurality of conditions including a surface state of the film, material of the film, a thickness of the film, and a shape of the bag to be produced, and also on the basis of information of the proper degree of vacuum determined in advance by the proper vacuum-degree determination section under the condition corresponding to the condition information.

5. The suction control apparatus according to claim 2, wherein the storage section is configured and arranged to store temporary information, which is information on the proper degree of vacuum determined by the proper vacuum-degree determination section during a temporary operation prior to a main operation, and the vacuum-degree control section is configured to control a vacuum-degree adjustment section included in the suction-type film conveyor at the proper degree of vacuum on the basis of the temporary information.

6. The suction control apparatus according to claim 2, wherein the storage section is configured and arranged to store main information, which is information on the proper degree of vacuum determined by the proper vacuum-degree determination section during a main operation, and the vacuum-degree control section is configured to control a vacuum-degree adjustment section included in the suction-type film conveyor at the proper degree of vacuum on the basis of the main information.

7. A packaging machine comprising:

the suction control apparatus according to claim 1; and the suction-type film conveyor controlled by the suction control apparatus to convey the belt-shaped film while suctioning the film.

8. A suction control apparatus adapted to be used in a packaging machine for conveying and packaging a belt-shaped film while the film is being suctioned by a suction-type film conveyor, the suction control apparatus comprising:

a conveying state detection section configured and arranged to detect a speed at which the film is conveyed or a conveying time required for a predetermined length of the film to be conveyed;

a storage section configured and arranged to store a set speed value for the conveying speed or a set time value for the conveying time;

a vacuum-degree determination section configured and arranged to determine a proper degree of vacuum of the suction-type film conveyor, which is less than a reference value set in advance, such that the film is drawn toward the conveying belt in response to the proper degree of vacuum being applied to the film; and a vacuum-degree control section configured to set the degree of vacuum to a first value corresponding to the proper degree of vacuum determined by the vacuum-degree determination section, the vacuum-degree control section being further configured to adjust the degree of vacuum so that the conveying speed falls within a predetermined range with respect to the set speed value, or so that the conveying time falls within a predetermined range with respect to the set conveying time value.

* * * * *